US012696926B2

(12) United States Patent
Campitelli et al.

(10) Patent No.: US 12,696,926 B2
(45) Date of Patent: Aug. 4, 2026

(54) AEROSOL GENERATING ARTICLE WITH FRONT END PLUG

(71) Applicant: Philip Morris Products S.A., Neuchatel (CH)

(72) Inventors: Gennaro Campitelli, Neuchatel (CH); Jerome Uthurry, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 420 days.

(21) Appl. No.: 18/247,769

(22) PCT Filed: Oct. 7, 2021

(86) PCT No.: PCT/EP2021/077720
§ 371 (c)(1),
(2) Date: Apr. 4, 2023

(87) PCT Pub. No.: WO2022/074131
PCT Pub. Date: Apr. 14, 2022

(65) Prior Publication Data

US 2023/0346009 A1 Nov. 2, 2023

(30) Foreign Application Priority Data

Oct. 9, 2020 (EP) ..... 20201052

(51) Int. Cl.
*A24D 1/20* (2020.01)
*A24D 3/02* (2006.01)
(Continued)

(52) U.S. Cl.
CPC ..... *A24D 1/20* (2020.01); *A24D 3/0279* (2013.01); *A24D 3/043* (2013.01); *A24D 3/10* (2013.01); *A24D 3/17* (2020.01)

(58) Field of Classification Search
None
See application file for complete search history.

(56) References Cited

U.S. PATENT DOCUMENTS 5,499,636 A 3/1996 Baggett, Jr. et al.
8,353,302 B2 1/2013 Olegario et al.
(Continued)

FOREIGN PATENT DOCUMENTS

CN 205865960 U 1/2017
CN 108294359 A 7/2018
(Continued)

OTHER PUBLICATIONS

International Search Report & Written Opinion issued Feb. 4, 2022 in PCT/EP2021/077720, filed on Oct. 7, 2021, 9 pages.
(Continued)

*Primary Examiner* — Cynthia Szewczyk
(74) *Attorney, Agent, or Firm* — Oblon, McClelland, Maier & Neustadt, L.L.P.

(57) ABSTRACT

An aerosol-generating article is provided, including: an aerosol-generating substrate; a downstream section extending from a downstream end of the aerosol-generating substrate to a downstream end of the aerosol-generating article; and an upstream section extending from an upstream end of the aerosol-generating substrate to an upstream end of the aerosol-generating article, a ratio of a resistance-to-draw of the upstream section to a resistance-to-draw of the downstream section being more than 1, and the resistance-to-draw of the upstream section being no more than 150 mm $H_2O$. An aerosol-generating system including an aerosol-generating device including a heater, and an aerosol-generating article, is also provided.

17 Claims, 2 Drawing Sheets

(51) Int. Cl.

| | |
|---|---|
| ***A24D 3/04*** | (2006.01) |
| ***A24D 3/10*** | (2006.01) |
| ***A24D 3/17*** | (2020.01) |

(56) References Cited

U.S. PATENT DOCUMENTS

| | | | | |
|---|---|---|---|---|
| 2016/0309782 | A1 | 10/2016 | Malgat et al. | |
| 2019/0075845 | A1 | 3/2019 | Malgat et al. | |
| 2020/0008462 | A1 | 1/2020 | Thorens | |
| 2020/0352220 | A1* | 11/2020 | Cheong | A24F 40/30 |
| 2020/0384221 | A1 | 12/2020 | Lang | |
| 2021/0000175 | A1* | 1/2021 | Hwang | A24F 40/57 |
| 2021/0321664 | A1 | 10/2021 | Malgat et al. | |

FOREIGN PATENT DOCUMENTS

| | | | | |
|---|---|---|---|---|
| CN | 110301675 | A | | 10/2019 | |
| CN | 110636761 | A | | 12/2019 | |
| CN | 111655059 | A | | 9/2020 | |
| CN | 111741689 | A | | 10/2020 | |
| EP | 0 822 760 | A2 | | 2/1998 | |
| EP | 3 566 590 | A1 | | 11/2019 | |
| EP | 3 616 537 | A1 | | 3/2020 | |
| JP | 2019-512235 | A | | 5/2019 | |
| JP | 2020-114206 | A | | 7/2020 | |
| RU | 2 609 191 | C2 | | 1/2017 | |
| RU | 2 620 491 | C2 | | 5/2017 | |
| RU | 2 665 435 | C1 | | 8/2018 | |
| WO | WO 99/00027 | A1 | | 1/1999 | |
| WO | WO 2010/133334 | A1 | | 11/2010 | |
| WO | WO 2015/176898 | A1 | | 11/2015 | |
| WO | WO-2017109626 | A1 | * | 6/2017 | A61M 15/0063 |
| WO | WO 2017/153443 | A1 | | 9/2017 | |
| WO | WO 2019/123048 | A1 | | 6/2019 | |
| WO | WO-2019130158 | A1 | * | 7/2019 | A61M 11/003 |
| WO | WO 2020/089081 | A1 | | 5/2020 | |
| WO | WO 2020/115151 | A1 | | 6/2020 | |
| WO | WO 2020/128043 | A1 | | 6/2020 | |
| WO | WO 2020/128045 | A1 | | 6/2020 | |
| WO | WO 2020/128048 | A1 | | 6/2020 | |
| WO | WO 2021/170649 | A1 | | 9/2021 | |
| WO | WO 2021/197810 | A1 | | 10/2021 | |
| WO | WO 2022/018301 | A1 | | 1/2022 | |

OTHER PUBLICATIONS

Combined Russian Notice of Allowance and Search Report issued Jan. 30, 2025 in Russian Patent Application No. 2023111694/03, 9 pages.

Extended European Search Report issued Mar. 22, 2021 in European Patent Application No. 20201052.6, 8 pages.

Combined Chinese Office Action and Search Report issued Jul. 19, 2025 in Chinese Patent Application No. 202180067068.X (with English Translation), 17 pages.

Philippines Office Action issued Aug. 29, 2025, in corresponding Philippines Patent Application No. 1/2023/550868, 6 pages.

Japanese Office Action issued Oct. 14, 2025, in corresponding Japanese Patent Application No. 2023-520186 (with English Translation), 9 pages.

Office Action and Search Report dated Nov. 25, 2025 in the corresponding Chinese Patent Application No. 202180067068.X (with English translation).

* cited by examiner

AEROSOL GENERATING ARTICLE WITH FRONT END PLUG

The present invention relates to an aerosol-generating article comprising an aerosol-generating substrate and adapted to produce an inhalable aerosol upon heating.

Aerosol-generating articles in which an aerosol-generating substrate, such as a tobacco-containing substrate, is heated rather than combusted, are known in the art. Typically, in such heated smoking articles an aerosol is generated by the transfer of heat from a heat source to a physically separate aerosol-generating substrate or material, which may be located in contact with, within, around, or downstream of the heat source. During use of the aerosol-generating article, volatile compounds are released from the aerosol-generating substrate by heat transfer from the heat source and are entrained in air drawn through the aerosol-generating article. As the released compounds cool, they condense to form an aerosol.

A number of prior art documents disclose aerosol-generating devices for consuming aerosol-generating articles. Such devices include, for example, electrically heated aerosol-generating devices in which an aerosol is generated by the transfer of heat from one or more electrical heater elements of the aerosol-generating device to the aerosol-generating substrate of a heated aerosol-generating article. For example, electrically heated aerosol-generating devices have been proposed that comprise an internal heater blade which is adapted to be inserted into the aerosol-generating substrate. As an alternative, inductively heatable aerosol-generating articles comprising an aerosol-generating substrate and a susceptor arranged within the aerosol-generating substrate have been proposed by WO 2015/176898. A further alternative has been described in WO 2020/115151, which discloses an aerosol-generating article used in combination with an external heating system comprising one or more heating elements arranged around the periphery of the aerosol-generating article.

Aerosol-generating articles in which a tobacco-containing substrate is heated rather than combusted present a number of challenges that were not encountered with conventional smoking articles. First of all, tobacco-containing substrates are typically heated to significantly lower temperatures compared with the temperatures reached by the combustion front in a conventional cigarette. This may have an impact on nicotine release from the tobacco-containing substrate and nicotine delivery to the consumer. At the same time, if the heating temperature is increased in an attempt to boost nicotine delivery, then the aerosol generated typically needs to be cooled to a greater extent and more rapidly before it reaches the consumer. However, technical solutions that were commonly used for cooling the mainstream smoke in conventional smoking articles, such as the provision of a high filtration efficiency segment at the mouth end of a cigarette, may have undesirable effects in an aerosol-generating article wherein a tobacco-containing substrate is heated rather than combusted, as they may reduce nicotine delivery.

In order to address one or more of the challenges specifically associated with heating rather than combusting an aerosol-generating substrate to generate an aerosol, a number of aerosol-generating articles have been proposed wherein multiple elements are combined, for example in longitudinal alignment, with an aerosol-generating element containing the aerosol-generating substrate. By way of example, the aerosol-generating element has been combined with a support element to impart improved structural strength to the article, an aerosol-cooling element adapted to lower the temperature of the aerosol, a low-filtration mouthpiece element, etc.

A need is generally felt for aerosol-generating articles that are easy to use, have improved practicality, and are more eco-friendly. Additionally, it would be desirable to provide aerosol-generating articles that are easier to manufacture and that may make the whole production chain more sustainable and cost-effective. There is also a need for an aerosol-generating article that is especially suitable for use in combination with an external heating system, and particularly one that has improved aerosol generation and aerosol former delivery.

Therefore, it would be desirable to provide a new and improved aerosol-generating article adapted to satisfy at least one of the needs described above. Further, it would be desirable to provide one such aerosol-generating article that can be manufactured efficiently and at high speed, preferably with a satisfactory low RTD variability from one article to another.

The present disclosure relates to an aerosol-generating article for producing an inhalable aerosol upon heating. The aerosol-generating article may comprise an aerosol-generating substrate. The aerosol generating article may comprise a downstream section extending from a downstream end of the aerosol-generating substrate to a downstream end of the aerosol-generating article. The aerosol generating article may comprise an upstream section extending from an upstream end of the aerosol-generating substrate to an upstream end of the aerosol-generating article. The ratio of the resistance to draw of the upstream section to the resistance to draw of the downstream section may be more than 1.

According to the present invention there is provided an aerosol-generating article for producing an inhalable aerosol upon heating, the aerosol-generating article comprises; an aerosol-generating substrate; a downstream section extending from a downstream end of the aerosol-generating substrate to a downstream end of the aerosol-generating article; and an upstream section extending from an upstream end of the aerosol-generating substrate to an upstream end of the aerosol-generating article. The ratio of the resistance to draw of the upstream section to the resistance to draw of the downstream section is more than 1

In embodiments of the present invention, the RTD of the upstream section is higher than the RTD of the downstream section. Where the downstream section has a relatively low RTD, for example an RTD of less than about 10 mm $H_2O$, the provision of an upstream element having a relatively high RTD may advantageously provide an acceptable overall RTD without the need for a high RTD element, such as a filter, downstream of the aerosol-generating substrate. This may maximise the delivery of the aerosol to a user without reducing the overall RTD of the aerosol-generating article unacceptably. In use, air enters the aerosol-generating article through the upstream end of the upstream section, passes through the upstream section and into the aerosol-generating substrate. The air then passes into and through the downstream section and then out of the downstream end of the downstream section.

The majority of the overall RTD of the aerosol-generating article may be accounted for by the RTD of the upstream section.

In accordance with the present invention there is provided an aerosol-generating article for generating an inhalable aerosol upon heating. The aerosol-generating article comprises an element comprising an aerosol-generating substrate.

The term "aerosol-generating article" is used herein to denote an article wherein an aerosol-generating substrate is heated to produce and deliver an inhalable aerosol to a consumer. As used herein, the term "aerosol-generating substrate" denotes a substrate capable of releasing volatile compounds upon heating to generate an aerosol.

A conventional cigarette is lit when a user applies a flame to one end of the cigarette and draws air through the other end. The localised heat provided by the flame and the oxygen in the air drawn through the cigarette causes the end of the cigarette to ignite, and the resulting combustion generates an inhalable smoke. By contrast, in heated aerosol-generating articles, an aerosol is generated by heating a flavour generating substrate, such as tobacco. Known heated aerosol-generating articles include, for example, electrically heated aerosol-generating articles and aerosol-generating articles in which an aerosol is generated by the transfer of heat from a combustible fuel element or heat source to a physically separate aerosol forming material. For example, aerosol-generating articles according to the invention find particular application in aerosol-generating systems comprising an electrically heated aerosol-generating device having an internal heater blade which is adapted to be inserted into the rod of aerosol-generating substrate. Aerosol-generating articles of this type are described in the prior art, for example, in EP 0822760.

As used herein, the term "aerosol-generating device" refers to a device comprising a heater element that interacts with the aerosol-generating substrate of the aerosol-generating article to generate an aerosol.

The aerosol-generating element may be in the form of a rod comprising or made of the aerosol-generating substrate. As used herein with reference to the present invention, the term "rod" is used to denote a generally cylindrical element of substantially circular, oval or elliptical cross-section.

As used herein, the term "longitudinal" refers to the direction corresponding to the main longitudinal axis of the aerosol-generating article, which extends between the upstream and downstream ends of the aerosol-generating article. As used herein, the terms "upstream" and "downstream" describe the relative positions of elements, or portions of elements, of the aerosol-generating article in relation to the direction in which the aerosol is transported through the aerosol-generating article during use.

During use, air is drawn through the aerosol-generating article in the longitudinal direction. The term "transverse" refers to the direction that is perpendicular to the longitudinal axis. Any reference to the "cross-section" of the aerosol-generating article or a component of the aerosol-generating article refers to the transverse cross-section unless stated otherwise.

The term "length" denotes the dimension of a component of the aerosol-generating article in the longitudinal direction. For example, it may be used to denote the dimension of the rod or of the elongate tubular elements in the longitudinal direction.

The aerosol-generating article further comprises a downstream section at a location downstream of the aerosol-generating substrate. As will become apparent from the following description of different embodiments of the aerosol-generating article of the invention, the downstream section may comprise one or more downstream elements.

In some embodiments, the downstream section may comprise a hollow section between the mouth end of the aerosol-generating article and the aerosol-generating element. The hollow section may comprise a hollow tubular element.

As used herein, the term "hollow tubular element" is used to denote a generally elongate element defining a lumen or airflow passage along a longitudinal axis thereof. In particular, the term "tubular" will be used in the following with reference to a tubular element having a substantially cylindrical cross-section and defining at least one airflow conduit establishing an uninterrupted fluid communication between an upstream end of the tubular element and a downstream end of the tubular element. However, it will be understood that alternative geometries (for example, alternative cross-sectional shapes) of the tubular element may be possible.

In the context of the present invention a hollow tubular element provides an unrestricted flow channel. This means that the hollow tubular element provides a negligible level of resistance to draw (RTD). The term "negligible level of RTD" is used to describe an RTD of less than 1 mm $H_2O$ per 10 millimetres of length of the hollow tubular element, preferably less than 0.4 mm $H_2O$ per 10 millimetres of length of the hollow tubular element, more preferably less than 0.1 mm $H_2O$ per 10 millimetres of length of the hollow tubular element.

The flow channel should therefore be free from any components that would obstruct the flow of air in a longitudinal direction. Preferably, the flow channel is substantially empty.

The aerosol-generating article may comprises a first ventilation zone at a location along the downstream section. In more detail, the aerosol-generating article may comprise a first ventilation zone at a location along the hollow tubular element. As such, fluid communication is established between the flow channel internally defined by the hollow tubular element and the outer environment.

The aerosol-generating article further comprises an upstream section at a location upstream of the rod of aerosol-generating substrate. The upstream section may comprise one or more upstream elements. In some embodiments, the upstream section may comprise an upstream element arranged immediately upstream of the aerosol-generating element.

As described briefly above, an aerosol-generating article in accordance with the present invention comprises an aerosol-generating substrate.

In some embodiments, the aerosol-generating element may be provided in the form of a rod comprising the aerosol-generating substrate. By way of example, the aerosol-generating element may comprise a rod of aerosol-generating substrate circumscribed by a wrapper.

The aerosol-generating substrate may have a length of at least about 5 millimetres. Preferably, the aerosol-generating substrate has a length of at least about 7 millimetres. More preferably, the aerosol-generating substrate has a length of at least about 10 millimetres. In particularly preferred embodiments, the aerosol-generating substrate has a length of at least about 12 millimetres.

The aerosol-generating substrate may have a length of up to about 80 millimetres. Preferably, the aerosol-generating substrate has a length of less than or equal to about 65 millimetres. More preferably, the aerosol-generating substrate has a length of less than or equal to about 60 millimetres. Even more preferably, the aerosol-generating substrate has a length of less than or equal to about 55 millimetres.

In particularly preferred embodiments, the aerosol-generating substrate has a length of less than or equal to about 50 millimetres, more preferably less than or equal to about 35 millimetres, even more preferably less than or equal to about 25 millimetres. In particularly preferred embodiments, the aerosol-generating substrate has a length of less than or equal to about 20 millimetres or even less than or equal to about 15 millimetres.

In some embodiments, the aerosol-generating substrate has a length from about 5 millimetres to about 60 millimetres, preferably from about 6 millimetres to about 60 millimetres, more preferably from about 7 millimetres to about 60 millimetres, even more preferably from about 10 millimetres to about 60 millimetres, most preferably from about 12 millimetres to about 60 millimetres. In other embodiments, the aerosol-generating substrate has a length from about 5 millimetres to about 55 millimetres, preferably from about 6 millimetres to about 55 millimetres, more preferably from about 7 millimetres to about 55 millimetres, even more preferably from about 10 millimetres to about 55 millimetres, most preferably from about 12 millimetres to about 55 millimetres. In further embodiments, the aerosol-generating substrate has a length from about 5 millimetres to about 50 millimetres, preferably from about 6 millimetres to about 50 millimetres, more preferably from about 7 millimetres to about 50 millimetres, even more preferably from about 10 millimetres to about 50 millimetres, most preferably from about 12 millimetres to about 50 millimetres.

In some particularly preferred embodiments, the aerosol-generating substrate has a length from about 5 millimetres to about 30 millimetres, preferably from about 6 millimetres to about 30 millimetres, more preferably from about 7 millimetres to about 30 millimetres, even more preferably from about 10 millimetres to about 30 millimetres. In other particularly preferred embodiments, the aerosol-generating substrate has a length from about 5 millimetres to about 20 millimetres, preferably from about 6 millimetres to about 20 millimetres, more preferably from about 7 millimetres to about 20 millimetres, even more preferably from about 10 millimetres to about 20 millimetres. In further particularly preferred embodiments, the aerosol-generating substrate has a length from about 5 millimetres to about 15 millimetres, preferably from about 7 millimetres to about 20 millimetres, more preferably from about 9 millimetres to about 16 millimetres, even more preferably from about 10 millimetres to about millimetres.

The aerosol-generating substrate preferably has an external diameter that is approximately equal to the external diameter of the aerosol-generating article.

Preferably, the aerosol-generating substrate has an external diameter of at least about 3 millimetres, at least about 4 millimetres or at least about 5 millimetres. More preferably, the aerosol-generating substrate has an external diameter of at least about 6 millimetres. Even more preferably, the aerosol-generating substrate has an external diameter of at least about 7 millimetres.

The aerosol-generating substrate preferably has an external diameter of less than or equal to about 12 millimetres. More preferably, the aerosol-generating substrate has an external diameter of less than or equal to about 10 millimetres. Even more preferably, the aerosol-generating substrate has an external diameter of less than or equal to about 8 millimetres.

In general, it has been observed that the smaller the diameter of the aerosol-generating substrate, the lower the temperature that is required to raise a core temperature of the aerosol-generating element such that sufficient amounts of vaporizable species are released from the aerosol-generating substrate to form a desired amount of aerosol. At the same time, without wishing to be bound by theory, it is understood that a smaller diameter of the aerosol-generating substrate allows for a faster penetration of heat supplied to the aerosol-generating article into the entire volume of aerosol-forming substrate. Nevertheless, where the diameter of the aerosol-generating substrate is too small, a volume-to-surface ratio of the aerosol-generating substrate becomes less favourable, as the amount of available aerosol-forming substrate diminishes.

A diameter of the aerosol-generating substrate falling within the ranges described herein is particularly advantageous in terms of a balance between energy consumption and aerosol delivery. This advantage is felt in particular when an aerosol-generating article comprising an aerosol-generating substrate having a diameter as described herein is used in combination with an external heater arranged around the periphery of the aerosol-generating article. Under such operating conditions, it has been observed that less thermal energy is required to achieve a sufficiently high temperature at the core of the aerosol-generating substrate and, in general, at the core of the article. Thus, when operating at lower temperatures, a desired target temperature at the core of the aerosol-generating substrate may be achieved within a desirably reduced time frame and by a lower energy consumption.

In some embodiments, the aerosol-generating substrate has an external diameter from about 5 millimetres to about 12 millimetres, preferably from about 6 millimetres to about 12 millimetres, more preferably from about 7 millimetres to about 12 millimetres. In other embodiments, the aerosol-generating substrate has an external diameter from about 5 millimetres to about 12 millimetres, preferably from about 6 millimetres to about 10 millimetres, more preferably from about 7 millimetres to about 10 millimetres. In further embodiments, the aerosol-generating substrate has an external diameter from about 5 millimetres to about 8 millimetres, preferably from about 6 millimetres to about 8 millimetres, more preferably from about 7 millimetres to about 8 millimetres.

The aerosol-generating substrate may have an external diameter of between 3.7 millimetres and 9 millimetres, or between 5.7 millimetres and 7.9 millimetres.

In particularly preferred embodiments, the aerosol-generating substrate has an external diameter of less than about 7.5 millimetres. By way of example, the aerosol-generating substrate may an external diameter of about 7.2 millimetres.

A length to diameter ratio of the aerosol-generating element may be at least about 0.5. Preferably, a length to diameter ratio of the aerosol-generating element is at least about 0.75. More preferably, a length to diameter ratio of the aerosol-generating element is at least about 1.0. Even more preferably, a length to diameter ratio of the aerosol-generating element is at least about 1.25.

A length to diameter ratio of the aerosol-generating element may be less than or equal to about 3.0. Preferably, a length to diameter ratio of the aerosol-generating element is less than or equal to about 2.75. More preferably, a length to diameter ratio of the aerosol-generating element is less than or equal to about 2.5. Even more preferably, a length to diameter ratio of the aerosol-generating element is less than or equal to about 2.25.

In some embodiments, a length to diameter ratio of the aerosol-generating element may be from about 0.5 to about 3.0. Preferably, a length to diameter ratio of the aerosol-generating element is from about 0.75 to about 3.0. More preferably, a length to diameter ratio of the aerosol-generating element is from about 1.0 to about 3.0. Even more preferably, a length to diameter ratio of the aerosol-generating element is from about 1.25 to about 3.0.

In other embodiments, a length to diameter ratio of the aerosol-generating element may be from about 0.5 to about 2.75. Preferably, a length to diameter ratio of the aerosol-generating element is from about 0.75 to about 2.75. More preferably, a length to diameter ratio of the aerosol-generating element is from about 1.0 to about 2.75. Even more preferably, a length to diameter ratio of the aerosol-generating element is from about 1.25 to about 2.75.

In further embodiments, a length to diameter ratio of the aerosol-generating element may be from about 0.5 to about 2.5. Preferably, a length to diameter ratio of the aerosol-generating element is from about 0.75 to about 2.5. More preferably, a length to diameter ratio of the aerosol-generating element is from about 1.0 to about 2.5. Even more preferably, a length to diameter ratio of the aerosol-generating element is from about 1.25 to about 2.5.

In yet further embodiments, a length to diameter ratio of the aerosol-generating element may be from about 0.5 to about 2.25. Preferably, a length to diameter ratio of the aerosol-generating element is from about 0.75 to about 2.25. More preferably, a length to diameter ratio of the aerosol-generating element is from about 1.0 to about 2.25. Even more preferably, a length to diameter ratio of the aerosol-generating element is from about 1.25 to about 2.25.

In particularly preferred embodiments, a length to diameter ratio of the aerosol-generating element may be at least about 1.3, more preferably about 1.4, even more preferably about 1.5.

In particularly preferred embodiments, a length to diameter ratio of the aerosol-generating element may be less than or equal to about 2.0, more preferably less than or equal to about 1.9, even more preferably less than or equal to about 1.8.

In some embodiments, a length to diameter ratio of the aerosol-generating element is preferably from about 1.3 to about 2.0, more preferably from about 1.4 to about 2.0, even more preferably from about 1.5 to about 2.0. In other embodiments, a length to diameter ratio of the aerosol-generating element is preferably from about 1.3 to about 1.9, more preferably from about 1.4 to about 1.7, even more preferably from about 1.5 to about 1.9. In further embodiments, a length to diameter ratio of the aerosol-generating element is preferably from about 1.3 to about 1.8, more preferably from about 1.4 to about 1.8, even more preferably from about 1.5 to about 1.8.

A ratio between the length of the aerosol-generating element and an overall length of the aerosol-generating article may be at least about 0.10. Preferably, a ratio between the length of the aerosol-generating element and an overall length of the aerosol-generating article is at least about 0.15. More preferably, a ratio between the length of the aerosol-generating element and an overall length of the aerosol-generating article is at least about 0.20. Even more preferably, a ratio between the length of the aerosol-generating element and an overall length of the aerosol-generating article is at least about 0.25.

In general, a ratio between the length of the aerosol-generating element and an overall length of the aerosol-generating article may be less than or equal to about 0.60. Preferably, a ratio between the length of the aerosol-generating element and an overall length of the aerosol-generating article is less than or equal to about 0.50. More preferably, a ratio between the length of the aerosol-generating element and an overall length of the aerosol-generating article is less than or equal to about 0.45. Even more preferably, a ratio between the length of the aerosol-generating element and an overall length of the aerosol-generating article is less than or equal to about 0.40. In particularly preferred embodiments, a ratio between the length of the aerosol-generating element and an overall length of the aerosol-generating article is less than or equal to about 0.35, and most preferably less than or equal to about 0.30.

In some embodiments, a ratio between the length of the aerosol-generating element and an overall length of the aerosol-generating article is from about 0.10 to about 0.45, preferably from about 0.15 to about 0.45, more preferably from about 0.20 to about 0.45, even more preferably from about 0.25 to about 0.45. In other embodiments, a ratio between the length of the aerosol-generating element and an overall length of the aerosol-generating article is from about 0.10 to about 0.40, preferably from about 0.15 to about 0.40, more preferably from about 0.20 to about 0.40, even more preferably from about 0.25 to about 0.40. In further embodiments, a ratio between the length of the aerosol-generating element and an overall length of the aerosol-generating article is from about 0.10 to about 0.35, preferably from about 0.15 to about 0.35, more preferably from about 0.20 to about 0.35, even more preferably from about 0.25 to about 0.35. In yet further embodiments, a ratio between the length of the aerosol-generating element and an overall length of the aerosol-generating article is from about 0.10 to about 0.30, preferably from about 0.15 to about 0.30, more preferably from about 0.20 to about 0.30, even more preferably from about 0.25 to about 0.30.

Preferably, the aerosol-generating element comprises a rod of aerosol-generating substrate having a substantially uniform cross-section along the length of the rod. Particularly preferably, the rod of aerosol-generating substrate has a substantially circular cross-section.

As will be described in greater detail below, an aerosol-generating article in accordance with the present invention comprises a downstream section comprising a hollow tubular element. In an aerosol-generating article in accordance with the present invention a ratio between the length of the aerosol-generating element and a length of the hollow tubular element may be less than or equal to about 0.66. Preferably, a ratio between the length of the aerosol-generating element and a length of the hollow tubular element may be less than or equal to about 0.60. More preferably, a ratio between the length of the aerosol-generating element and a length of the hollow tubular element may be less than or equal to about 0.50. Even more preferably, a ratio between the length of the aerosol-generating element and a length of the hollow tubular element may be less than or equal to about 0.40.

In an aerosol-generating article in accordance with the present invention a ratio between the length of the aerosol-generating element and a length of the hollow tubular element may be at least about 0.10. Preferably, a ratio between the length of the aerosol-generating element and a length of the hollow tubular element may be at least about 0.15. More preferably, a ratio between the length of the aerosol-generating element and a length of the hollow tubular element may be at least about 0.20. Even more preferably, a ratio between the length of the aerosol-generating element and a length of the hollow tubular element may be at least about 0.25. In particularly preferred embodiments, a ratio between the length of the aerosol-generating element and a length of the hollow tubular element may be at least about 0.30.

In some embodiments, a ratio between the length of the aerosol-generating element and a length of the hollow tubular element is from about 0.15 to about 0.60, preferably from about 0.20 to about 0.60, more preferably from about 0.25 to about 0.60, even more preferably from about 0.30 to about 0.60. In other embodiments, a ratio between the length of the aerosol-generating element and a length of the hollow tubular element is from about 0.15 to about 0.50, preferably from about 0.20 to about 0.50, more preferably from about 0.25 to about 0.50, even more preferably from about 0.30 to about 0.50. In further embodiments, a ratio between the length of the aerosol-generating element and a length of the hollow tubular element is from about 0.15 to about 0.40, preferably from about 0.20 to about 0.40, more preferably from about 0.25 to about 0.40, even more preferably from about 0.30 to about 0.40. By way of example, a ratio between the length of the aerosol-generating element and a length of the hollow tubular element may be about 0.35.

A density of the aerosol-generating substrate may be at least about 100 micrograms/cubic centimetre. Preferably, a density of the aerosol-generating substrate is at least about 115 micrograms/cubic centimetre. More preferably, a density of the aerosol-generating substrate is at least about 130 micrograms/cubic centimetre. Even more preferably, a density of the aerosol-generating substrate is at least about 140 micrograms/cubic centimetre.

A density of the aerosol-generating substrate may be less than or equal to about 200 micrograms/cubic centimetre. Preferably, a density of the aerosol-generating substrate is less than or equal to about 185 micrograms/cubic centimetre. More preferably, a density of the aerosol-generating substrate is less than or equal to about 170 micrograms/cubic centimetre. Even more preferably, a density of the aerosol-generating substrate is less than or equal to about 160 micrograms/cubic centimetre.

In some embodiments, a density of the aerosol-generating substrate is from 100 micrograms/cubic centimetre to 200 micrograms/cubic centimetre, preferably from 100 micrograms/cubic centimetre to 185 micrograms/cubic centimetre, more preferably from 100 micrograms/cubic centimetre to 170 micrograms/cubic centimetre, even more preferably from 100 micrograms/cubic centimetre to 160 micrograms/cubic centimetre. In other embodiments, a density of the aerosol-generating substrate is from 115 micrograms/cubic centimetre to 200 micrograms/cubic centimetre, preferably from 115 micrograms/cubic centimetre to 185 micrograms/cubic centimetre, more preferably from 115 micrograms/cubic centimetre to 170 micrograms/cubic centimetre, even more preferably from 115 micrograms/cubic centimetre to 160 micrograms/cubic centimetre. In further embodiments, a density of the aerosol-generating substrate is from 130 micrograms/cubic centimetre to 200 micrograms/cubic centimetre, preferably from 130 micrograms/cubic centimetre to 185 micrograms/cubic centimetre, more preferably from 130 micrograms/cubic centimetre to 170 micrograms/cubic centimetre, even more preferably from 130 micrograms/cubic centimetre to 160 micrograms/cubic centimetre. In yet other embodiments, a density of the aerosol-generating substrate is from 140 micrograms/cubic centimetre to 200 micrograms/cubic centimetre, preferably from 140 micrograms/cubic centimetre to 185 micrograms/cubic centimetre, more preferably from 140 micrograms/cubic centimetre to 170 micrograms/cubic centimetre, even more preferably from 140 micrograms/cubic centimetre to 160 micrograms/cubic centimetre. In some particularly preferred embodiments, a density of the aerosol-generating substrate is about 150 micrograms/cubic centimetre.

A density of the aerosol-generating substrate may be at least about 100 milligrams/cubic centimetre. Preferably, a density of the aerosol-generating substrate is at least about 115 milligrams/cubic centimetre. More preferably, a density of the aerosol-generating substrate is at least about 130 milligrams/cubic centimetre. Even more preferably, a density of the aerosol-generating substrate is at least about 140 milligrams/cubic centimetre.

A density of the aerosol-generating substrate may be less than or equal to about 200 milligrams/cubic centimetre. Preferably, a density of the aerosol-generating substrate is less than or equal to about 185 milligrams/cubic centimetre. More preferably, a density of the aerosol-generating substrate is less than or equal to about 170 milligrams/cubic centimetre. Even more preferably, a density of the aerosol-generating substrate is less than or equal to about 160 milligrams/cubic centimetre.

In some embodiments, a density of the aerosol-generating substrate is from 100 milligrams/cubic centimetre to 200 milligrams/cubic centimetre, preferably from 100 milligrams/cubic centimetre to 185 milligrams/cubic centimetre, more preferably from 100 milligrams/cubic centimetre to 170 milligrams/cubic centimetre, even more preferably from 100 milligrams/cubic centimetre to 160 milligrams/cubic centimetre. In other embodiments, a density of the aerosol-generating substrate is from 115 milligrams/cubic centimetre to 200 milligrams/cubic centimetre, preferably from 115 milligrams/cubic centimetre to 185 milligrams/cubic centimetre, more preferably from 115 milligrams/cubic centimetre to 170 milligrams/cubic centimetre, even more preferably from 115 milligrams/cubic centimetre to 160 milligrams/cubic centimetre. In further embodiments, a density of the aerosol-generating substrate is from 130 milligrams/cubic centimetre to 200 milligrams/cubic centimetre, preferably from 130 milligrams/cubic centimetre to 185 milligrams/cubic centimetre, more preferably from 130 milligrams/cubic centimetre to 170 milligrams/cubic centimetre, even more preferably from 130 milligrams/cubic centimetre to 160 milligrams/cubic centimetre. In yet other embodiments, a density of the aerosol-generating substrate is from 140 milligrams/cubic centimetre to 200 milligrams/cubic centimetre, preferably from 140 milligrams/cubic centimetre to 185 milligrams/cubic centimetre, more preferably from 140 milligrams/cubic centimetre to 170 milligrams/cubic centimetre, even more preferably from 140 milligrams/cubic centimetre to 160 milligrams/cubic centimetre. In some particularly preferred embodiments, a density of the aerosol-generating substrate is about 150 milligrams/cubic centimetre.

By way of example, the aerosol-generating element may comprise from about 100 milligrams to about 250 milligrams of aerosol-generating substrate. In some embodiments, the aerosol-generating element comprises from about 210 milligrams to about 230 milligrams of aerosol-generating substrate, preferably from 215 milligrams to about 220 milligrams of aerosol-generating substrate. In other embodiments, the aerosol-generating element comprises from about 150 milligrams to about 180 milligrams of aerosol-generating substrate, preferably from 160 milligrams to about 165 milligrams of aerosol-generating substrate.

The aerosol-generating substrate may be a solid aerosol-generating substrate.

In certain preferred embodiments, the aerosol-generating substrate comprises homogenised plant material, preferably a homogenised tobacco material.

As used herein, the term "homogenised plant material" encompasses any plant material formed by the agglomeration of particles of plant. For example, sheets or webs of homogenised tobacco material for the aerosol-generating substrates of the present invention may be formed by agglomerating particles of tobacco material obtained by pulverising, grinding or comminuting plant material and optionally one or more of tobacco leaf lamina and tobacco leaf stems. The homogenised plant material may be produced by casting, extrusion, paper making processes or other any other suitable processes known in the art.

The homogenised plant material can be provided in any suitable form.

In some embodiments, the homogenised plant material may be in the form of one or more sheets. As used herein with reference to the invention, the term "sheet" describes a laminar element having a width and length substantially greater than the thickness thereof.

The homogenised plant material may be in the form of a plurality of pellets or granules.

The homogenised plant material may be in the form of a plurality of strands, strips or shreds. As used herein, the term "strand" describes an elongate element of material having a length that is substantially greater than the width and thickness thereof. The term "strand" should be considered to encompass strips, shreds and any other homogenised plant material having a similar form. The strands of homogenised plant material may be formed from a sheet of homogenised plant material, for example by cutting or shredding, or by other methods, for example, by an extrusion method.

In some embodiments, the strands may be formed in situ within the aerosol-generating substrate as a result of the splitting or cracking of a sheet of homogenised plant material during formation of the aerosol-generating substrate, for example, as a result of crimping. The strands of homogenised plant material within the aerosol-generating substrate may be separate from each other. Alternatively, each strand of homogenised plant material within the aerosol-generating substrate may be at least partially connected to an adjacent strand or strands along the length of the strands. For example, adjacent strands may be connected by one or more fibres. This may occur, for example, where the strands have been formed due to the splitting of a sheet of homogenised plant material during production of the aerosol-generating substrate, as described above.

Where the aerosol-generating substrate comprises a homogenised plant material, the homogenised plant material may typically be provided in the form of one or more sheets. In particular, sheets of homogenised plant material may be produced by a casting process. Preferably, sheets of homogenised plant material may be produced by a paper-making process.

In some preferred embodiments, the aerosol-generating substrate comprises cut filler. Within the context of the present specification, the term "cut filler" is used to describe to a blend of shredded plant material, such as tobacco plant material, including, in particular, one or more of leaf lamina, processed stems and ribs, homogenised plant material.

The cut filler may also comprise other after-cut, filler tobacco or casing.

Preferably, the cut filler comprises at least 25 percent of plant leaf lamina, more preferably, at least 50 percent of plant leaf lamina, still more preferably at least 75 percent of plant leaf lamina and most preferably at least 90 percent of plant leaf lamina. Preferably, the plant material is one of tobacco, mint, tea and cloves. However, as will be discussed below in greater detail, the invention is equally applicable to other plant material that has the ability to release substances upon the application of heat that can subsequently form an aerosol.

Preferably, the cut filler comprises tobacco plant material comprising lamina of one or more of bright tobacco, dark tobacco, aromatic tobacco and filler tobacco. With reference to the present invention, the term "tobacco" describes any plant member of the genus *Nicotiana*. Bright tobaccos are tobaccos with a generally large, light coloured leaves. Throughout the specification, the term "bright tobacco" is used for tobaccos that have been flue cured. Examples for bright tobaccos are Chinese Flue-Cured, Flue-Cured Brazil, US Flue-Cured such as Virginia tobacco, Indian Flue-Cured, Flue-Cured from Tanzania or other African Flue Cured. Bright tobacco is characterized by a high sugar to nitrogen ratio. From a sensorial perspective, bright tobacco is a tobacco type which, after curing, is associated with a spicy and lively sensation. Within the context of the present invention, bright tobaccos are tobaccos with a content of reducing sugars of between about 2.5 percent and about 20 percent of dry weight base of the leaf and a total ammonia content of less than about 0.12 percent of dry weight base of the leaf. Reducing sugars comprise for example glucose or fructose. Total ammonia comprises for example ammonia and ammonia salts.

Dark tobaccos are tobaccos with a generally large, dark coloured leaves. Throughout the specification, the term "dark tobacco" is used for tobaccos that have been air cured. Additionally, dark tobaccos may be fermented. Tobaccos that are used mainly for chewing, snuff, cigar, and pipe blends are also included in this category. Typically, these dark tobaccos are air cured and possibly fermented. From a sensorial perspective, dark tobacco is a tobacco type which, after curing, is associated with a smoky, dark cigar type sensation. Dark tobacco is characterized by a low sugar to nitrogen ratio. Examples for dark tobacco are Burley Malawi or other African Burley, Dark Cured Brazil *Galpao*, Sun Cured or Air Cured Indonesian Kasturi. According to the invention, dark tobaccos are tobaccos with a content of reducing sugars of less than about 5 percent of dry weight base of the leaf and a total ammonia content of up to about 0.5 percent of dry weight base of the leaf.

Aromatic tobaccos are tobaccos that often have small, light coloured leaves. Throughout the specification, the term "aromatic tobacco" is used for other tobaccos that have a high aromatic content, e.g. of essential oils. From a sensorial perspective, aromatic tobacco is a tobacco type which, after curing, is associated with spicy and aromatic sensation. Example for aromatic tobaccos are Greek Oriental, Oriental Turkey, semi-oriental tobacco but also Fire Cured, US Burley, such as Perique, Rustica, US Burley or Meriland. Filler tobacco is not a specific tobacco type, but it includes tobacco types which are mostly used to complement the other tobacco types used in the blend and do not bring a specific characteristic aroma direction to the final product. Examples for filler tobaccos are stems, midrib or stalks of other tobacco types. A specific example may be flue cured stems of Flue Cure Brazil lower stalk.

The cut filler suitable to be used with the present invention generally may resemble cut filler used for conventional smoking articles. The cut width of the cut filler preferably is between 0.3 millimetres and 2.0 millimetres, more preferably, the cut width of the cut filler is between 0.5 millimetres and 1.2 millimetres and most preferably, the cut width of the cut filler is between 0.6 millimetres and 0.9 millimetres. The cut width may play a role in the distribution of heat inside the aerosol-generating element. Also, the cut width may play a role in the resistance to draw of the article. Further, the cut width may impact the overall density of the aerosol-generating substrate as a whole.

The strand length of the cut-filler is to some extent a random value as the length of the strands will depend on the overall size of the object that the strand is cut off from. Nevertheless, by conditioning the material before cutting, for example by controlling the moisture content and the overall subtlety of the material, longer strands can be cut. Preferably, the strands have a length of between about 10 millimetres and about 40 millimetres before the strands are collated to form the aerosol-generating element. Obviously, if the strands are arranged in an aerosol-generating element in a longitudinal extension where the longitudinal extension of the section is below 40 millimetres, the final aerosol-generating element may comprise strands that are on average shorter than the initial strand length. Preferably, the strand length of the cut-filler is such that between about 20 percent and 60 percent of the strands extend along the full length of the aerosol-generating element. This prevents the strands from dislodging easily from the aerosol-generating element.

In preferred embodiments, the weight of the cut filler is between 80 milligrams and 400 milligrams, preferably between 150 milligrams and 250 milligrams, more preferably between 170 milligrams and 220 milligrams. This amount of cut filler typically allows for sufficient material for the formation of an aerosol. Additionally, in the light of the aforementioned constraints on diameter and size, this allows for a balanced density of the aerosol-generating element between energy uptake, resistance to draw and fluid passageways within the aerosol-generating element where the aerosol-generating substrate comprises plant material.

Preferably, the cut filler is soaked with aerosol former. Soaking the cut filler can be done by spraying or by other suitable application methods. The aerosol former may be applied to the blend during preparation of the cut filler. For example, the aerosol former may be applied to the blend in the direct conditioning casing cylinder (DCCC). Conventional machinery can be used for applying an aerosol former to the cut filler. The aerosol former may be any suitable known compound or mixture of compounds that, in use, facilitates formation of a dense and stable aerosol. The aerosol former may be facilitating that the aerosol is substantially resistant to thermal degradation at temperatures typically applied during use of the aerosol-generating article. Suitable aerosol formers are for example to: polyhydric alcohols such as, for example, triethylene glycol, 1,3-butanediol, propylene glycol and glycerine; esters of polyhydric alcohols such as, for example, glycerol mono-, di- or triacetate; aliphatic esters of mono-, di- or polycarboxylic acids such as, for example, dimethyl dodecanedioate and dimethyl tetradecanedioate; and combinations thereof.

Preferably, the aerosol former comprises one or more of glycerine and propylene glycol. The aerosol former may consist of glycerine or propylene glycol or of a combination of glycerine and propylene glycol.

Preferably, the amount of aerosol former is between 6 percent and 20 percent by weight on a dry weight basis of the cut filler, more preferably, the amount of aerosol former is between 8 percent and 18 percent by weight on a dry weight basis of the cut filler, most preferably the amount of aerosol former is between 10 percent and 15 percent by weight on a dry weight basis of the cut filler. When aerosol former is added to the cut filler in the amounts described above, the cut filler may become relatively sticky. This advantageously help retain the cut filler at a predetermined location within the article, as the particles of cut filler display a tendency to adhere to surrounding cut filler particles as well as to surrounding surfaces (for example, the internal surface of a wrapper circumscribing the cut filler).

For some embodiments the amount of aerosol former has a target value of about 13 percent by weight on a dry weight basis of the cut filler. The most efficient amount of aerosol former will depend also on the cut filler, whether the cut filler comprises plant lamina or homogenized plant material. For example, among other factors, the type of cut filler will determine to which extent the aerosol-former can facilitate the release of substances from the cut filler.

For these reasons, an aerosol-generating element comprising cut filler as described above is capable of efficiently generating sufficient amount of aerosol at relatively low temperatures. A temperature of between 150 degrees Celsius and 200 degrees Celsius in the heating chamber is sufficient for one such cut filler to generate sufficient amounts of aerosol while in aerosol-generating devices using tobacco cast leave sheets typically temperatures of about 250 degrees Celsius are employed.

A further advantage connected with operating at lower temperatures is that there is a reduced need to cool down the aerosol. As generally low temperatures are used, a simpler cooling function may be sufficient. This in turn allows using a simpler and less complex structure of the aerosol-generating article.

As described briefly above, where the aerosol-generating substrate comprises a homogenised plant material, the homogenised plant material may be provided in the form of one or more sheets.

The one or more sheets as described herein may each individually have a thickness of between 100 micrometres and 600 micrometres, preferably between 150 micrometres and 300 micrometres, and most preferably between 200 micrometres and 250 micrometres. Individual thickness refers to the thickness of the individual sheet, whereas combined thickness refers to the total thickness of all sheets that make up the aerosol-generating substrate. For example, if the aerosol-generating substrate is formed from two individual sheets, then the combined thickness is the sum of the thickness of the two individual sheets or the measured thickness of the two sheets where the two sheets are stacked in the aerosol-generating substrate.

The one or more sheets as described herein may each individually have a grammage of between about 100 grams per square metre and about 600 grams per square metre.

The one or more sheets as described herein may each individually have a density of from about 0.3 grams per cubic centimetre to about 1.3 grams per cubic centimetre, and preferably from about 0.7 grams per cubic centimetre to about 1.0 gram per cubic centimetre.

In embodiments of the present invention in which the aerosol-generating substrate comprises one or more sheets of homogenised plant material, the sheets are preferably in the form of one or more gathered sheets. As used herein, the term "gathered" denotes that the sheet of homogenised plant material is convoluted, folded, or otherwise compressed or constricted substantially transversely to the cylindrical axis of a plug or a rod.

The one or more sheets of homogenised plant material may be gathered transversely relative to the longitudinal axis thereof and circumscribed with a wrapper to form a continuous rod or a plug.

The one or more sheets of homogenised plant material may advantageously be crimped or similarly treated. As used herein, the term "crimped" denotes a sheet having a plurality of substantially parallel ridges or corrugations. Alternatively or in addition to being crimped, the one or more sheets of homogenised plant material may be embossed, debossed, perforated or otherwise deformed to provide texture on one or both sides of the sheet.

Preferably, each sheet of homogenised plant material may be crimped such that it has a plurality of ridges or corrugations substantially parallel to the cylindrical axis of the plug. This treatment advantageously facilitates gathering of the crimped sheet of homogenised plant material to form the plug. Preferably, the one or more sheets of homogenised plant material may be gathered. It will be appreciated that crimped sheets of homogenised plant material may have a plurality of substantially parallel ridges or corrugations disposed at an acute or obtuse angle to the cylindrical axis of the plug. The sheet may be crimped to such an extent that the integrity of the sheet becomes disrupted at the plurality of parallel ridges or corrugations causing separation of the material, and results in the formation of shreds, strands or strips of homogenised plant material.

Alternatively, the one or more sheets of homogenised plant material may be cut into strands as referred to above. In such embodiments, the aerosol-generating substrate comprises a plurality of strands of the homogenised plant material. The strands may be used to form a plug. Typically, the width of such strands is about 5 millimetres, or about 4 millimetres, or about 3 millimetres, or about 2 millimetres or less. The length of the strands may be greater than about 5 millimetres, between about 5 millimetres to about 15 millimetres, about 8 millimetres to about 12 millimetres, or about 12 millimetres. Preferably, the strands have substantially the same length as each other.

The homogenised plant material may comprise up to about 95 percent by weight of plant particles, on a dry weight basis. Preferably, the homogenised plant material comprises up to about 90 percent by weight of plant particles, more preferably up to about 80 percent by weight of plant particles, more preferably up to about 70 percent by weight of plant particles, more preferably up to about 60 percent by weight of plant particles, more preferably up to about 50 percent by weight of plant particles, on a dry weight basis.

For example, the homogenised plant material may comprise between about 2.5 percent and about 95 percent by weight of plant particles, or about 5 percent and about 90 percent by weight of plant particles, or between about 10 percent and about 80 percent by weight of plant particles, or between about 15 percent and about 70 percent by weight of plant particles, or between about 20 percent and about 60 percent by weight of plant particles, or between about 30 percent and about 50 percent by weight of plant particles, on a dry weight basis.

In certain embodiments of the invention, the homogenised plant material is a homogenised tobacco material comprising tobacco particles. Sheets of homogenised tobacco material for use in such embodiments of the invention may have a tobacco content of at least about 40 percent by weight on a dry weight basis, more preferably of at least about 50 percent by weight on a dry weight basis more preferably at least about 70 percent by weight on a dry weight basis and most preferably at least about 90 percent by weight on a dry weight basis.

With reference to the present invention, the term "tobacco particles" describes particles of any plant member of the genus *Nicotiana*. The term "tobacco particles" encompasses ground or powdered tobacco leaf lamina, ground or powdered tobacco leaf stems, tobacco dust, tobacco fines, and other particulate tobacco by-products formed during the treating, handling and shipping of tobacco. In a preferred embodiment, the tobacco particles are substantially all derived from tobacco leaf lamina. By contrast, isolated nicotine and nicotine salts are compounds derived from tobacco but are not considered tobacco particles for purposes of the invention and are not included in the percentage of particulate plant material.

The aerosol-generating substrate may further comprise one or more aerosol formers. Upon volatilisation, an aerosol former can convey other vaporised compounds released from the aerosol-generating substrate upon heating, such as nicotine and flavourants, in an aerosol. Suitable aerosol formers for inclusion in the homogenised plant material are known in the art and include, but are not limited to: polyhydric alcohols, such as triethylene glycol, propylene glycol, 1,3-butanediol and glycerol; esters of polyhydric alcohols, such as glycerol mono-, di- or triacetate; and aliphatic esters of mono-, di- or polycarboxylic acids, such as dimethyl dodecanedioate and dimethyl tetradecanedioate.

The aerosol-generating substrate may have an aerosol former content of between about 5 percent and about 30 percent by weight on a dry weight basis, such as between about percent and about 25 percent by weight on a dry weight basis, or between about 15 percent and about 20 percent by weight on a dry weight basis.

For example, if the substrate is intended for use in an aerosol-generating article for an electrically-operated aerosol-generating system having a heating element, it may preferably include an aerosol former content of between about 5 percent to about 30 percent by weight on a dry weight basis. If the substrate is intended for use in an aerosol-generating article for an electrically-operated aerosol-generating system having a heating element, the aerosol former is preferably glycerol.

In other embodiments, the aerosol-generating substrate may have an aerosol former content of about 1 percent to about 5 percent by weight on a dry weight basis. For example, if the substrate is intended for use in an aerosol-generating article in which aerosol former is kept in a reservoir separate from the substrate, the substrate may have an aerosol former content of greater than 1 percent and less than about 5 percent. In such embodiments, the aerosol former is volatilised upon heating and a stream of the aerosol former is contacted with the aerosol-generating substrate so as to entrain the flavours from the aerosol-generating substrate in the aerosol.

In other embodiments, the aerosol-generating substrate may have an aerosol former content of about 30 percent by weight to about 45 percent by weight. This relatively high level of aerosol former is particularly suitable for aerosol-generating substrates that are intended to be heated at a temperature of less than 275 degrees Celsius. In such embodiments, the aerosol-generating substrate preferably further comprises between about 2 percent by weight and about 10 percent by weight of cellulose ether, on a dry weight basis and between about percent by weight and about 50 percent by weight of additional cellulose, on a dry weight basis. The use of the combination of cellulose ether and additional cellulose has been found to provide a particularly effective delivery of aerosol when used in an aerosol-generating substrate having an aerosol former content of between 30 percent by weight and 45 percent by weight.

Suitable cellulose ethers include but are not limited to methyl cellulose, hydroxypropyl methyl cellulose, ethyl cellulose, hydroxyl ethyl cellulose, hydroxyl propyl cellulose, ethyl hydroxyl ethyl cellulose and carboxymethyl cellulose (CMC). In particularly preferred embodiments, the cellulose ether is carboxymethyl cellulose.

As used herein, the term "additional cellulose" encompasses any cellulosic material incorporated into the aerosol-generating substrate which does not derive from the non-tobacco plant particles or tobacco particles provided in the aerosol-generating substrate. The additional cellulose is therefore incorporated in the aerosol-generating substrate in addition to the non-tobacco plant material or tobacco material, as a separate and distinct source of cellulose to any cellulose intrinsically provided within the non-tobacco plant particles or tobacco particles. The additional cellulose will typically derive from a different plant to the non-tobacco plant particles or tobacco particles. Preferably, the additional cellulose is in the form of an inert cellulosic material, which is sensorially inert and therefore does not substantially impact the organoleptic characteristics of the aerosol generated from the aerosol-generating substrate. For example, the additional cellulose is preferably a tasteless and odourless material.

The additional cellulose may comprise cellulose powder, cellulose fibres, or a combination thereof.

The aerosol former may act as a humectant in the aerosol-generating substrate.

The wrapper circumscribing the rod of homogenised plant material may be a paper wrapper or a non-paper wrapper. Suitable paper wrappers for use in specific embodiments of the invention are known in the art and include, but are not limited to: cigarette papers; and filter plug wraps. Suitable non-paper wrappers for use in specific embodiments of the invention are known in the art and include, but are not limited to sheets of homogenised tobacco materials. In certain preferred embodiments, the wrapper may be formed of a laminate material comprising a plurality of layers. Preferably, the wrapper is formed of an aluminium co-laminated sheet. The use of a co-laminated sheet comprising aluminium advantageously prevents combustion of the aerosol-generating substrate in the event that the aerosol-generating substrate should be ignited, rather than heated in the intended manner.

In certain alternative embodiments of the present invention, the aerosol-generating substrate comprises a gel composition that includes an alkaloid compound, or a cannabinoid compound, or both an alkaloid compound and a cannabinoid compound. In particularly preferred embodiments, the aerosol-generating substrate comprises a gel composition that includes nicotine.

Preferably, the gel composition comprises an alkaloid compound, or a cannabinoid compound, or both an alkaloid compound and a cannabinoid compound; an aerosol former; and at least one gelling agent. Preferably, the at least one gelling agent forms a solid medium and the glycerol is dispersed in the solid medium, with the alkaloid or cannabinoid dispersed in the glycerol. Preferably, the gel composition is a stable gel phase.

Advantageously, a stable gel composition comprising nicotine provides predictable composition form upon storage or transit from manufacture to the consumer. The stable gel composition comprising nicotine substantially maintains its shape. The stable gel composition comprising nicotine substantially does not release a liquid phase upon storage or transit from manufacture to the consumer. The stable gel composition comprising nicotine may provide for a simple consumable design. This consumable may not have to be designed to contain a liquid, thus a wider range of materials and container constructions may be contemplated.

The gel composition described herein may be combined with an aerosol-generating device to provide a nicotine aerosol to the lungs at inhalation or air flow rates that are within conventional smoking regime inhalation or air flow rates. The aerosol-generating device may continuously heat the gel composition. A consumer may take a plurality of inhalations or "puffs" where each "puff" delivers an amount of nicotine aerosol. The gel composition may be capable of delivering a high nicotine/low total particulate matter (TPM) aerosol to a consumer when heated, preferably in a continuous manner.

The phrase "stable gel phase" or "stable gel" refers to gel that substantially maintains its shape and mass when exposed to a variety of environmental conditions. The stable gel may not substantially release (sweat) or absorb water when exposed to a standard temperature and pressure while varying relative humidity from about 10 percent to about 60 percent. For example, the stable gel may substantially maintain its shape and mass when exposed to a standard temperature and pressure while varying relative humidity from about percent to about 60 percent.

The gel composition includes an alkaloid compound, or a cannabinoid compound, or both an alkaloid compound and a cannabinoid compound. The gel composition may include one or more alkaloids. The gel composition may include one or more cannabinoids. The gel composition may include a combination of one or more alkaloids and one or more cannabinoids.

The term "alkaloid compound" refers to any one of a class of naturally occurring organic compounds that contain one or more basic nitrogen atoms. Generally, an alkaloid contains at least one nitrogen atom in an amine-type structure. This or another nitrogen atom in the molecule of the alkaloid compound can be active as a base in acid-base reactions. Most alkaloid compounds have one or more of their nitrogen atoms as part of a cyclic system, such as for example a heterocylic ring. In nature, alkaloid compounds are found primarily in plants, and are especially common in certain families of flowering plants. However, some alkaloid compounds are found in animal species and fungi. In this disclosure, the term "alkaloid compound" refers to both naturally derived alkaloid compounds and synthetically manufactured alkaloid compounds.

The gel composition may preferably include an alkaloid compound selected from the group consisting of nicotine, anatabine, and combinations thereof.

Preferably the gel composition includes nicotine.

The term "nicotine" refers to nicotine and nicotine derivatives such as free-base nicotine, nicotine salts and the like.

The term "cannabinoid compound" refers to any one of a class of naturally occurring compounds that are found in parts of the *cannabis* plant-namely the species *Cannabis sativa, Cannabis indica*, and *Cannabis ruderalis*. Cannabinoid compounds are especially concentrated in the female flower heads. Cannabinoid compounds naturally occurring in the *cannabis* plant include cannabidiol (CBD) and tetrahydrocannabinol (THC). In this disclosure, the term "cannabinoid compounds" is used to describe both naturally derived cannabinoid compounds and synthetically manufactured cannabinoid compounds.

Embodiments of the invention in which the aerosol-generating element comprises an aerosol-generating substrate comprising a gel composition, as described above, may advantageously comprise an upstream element upstream of the aerosol-generating element. In this case, the upstream element advantageously prevents physical contact with the gel composition. The upstream element can also advantageously compensate for any potential reduction in RTD, for example, due to evaporation of the gel composition upon heating of the aerosol-generating element during use.

Further details about the provision of one such upstream element will be described below.

The downstream section may have any length. The downstream section may have a length of at least about 10 millimetres. For example, the downstream section may have a length of at least about 15 millimetres, at least about 20 millimetres, at least about 25 millimetres, or at least about 30 millimetres.

The provision of a downstream section having a length greater than the values set out above may advantageously provide space for the aerosol to cool and condense before reaching the consumer. This may also ensure a user is spaced apart from the heating element when the aerosol-generating article is used in conjunction with an aerosol-generating device.

The downstream section may have a length of no more than about 60 millimetres. For example, the downstream section may have a length of no more than about 50 millimetres, no more than about 55 millimetres, no more than about 40 millimetres, or no more than about millimetres.

The downstream section may have a length of between about 10 millimetres and about 60 millimetres, between about 15 millimetres and about 50 millimetres, between about 20 millimetres and about 55 millimetres, between about 25 millimetres and about 40 millimetres, or between about 30 millimetres and about 35 millimetres. For example, the downstream section may have a length of about 33 millimetres.

A ratio between the length of the downstream section and the length of the aerosol-generating substrate may be from about 1.0 to about 4.5.

Preferably, a ratio between the length of the downstream section and the length of the aerosol-generating substrate is at least about 1.5, more preferably at least about 2.0, even more preferably at least about 2.5. In preferred embodiments, a ratio between the length of the downstream section and the length of the aerosol-generating substrate is less than about 4.0, more preferably less than about 3.5, even more preferably less than about 3.0.

In some embodiments, a ratio between the length of the downstream section and the length of the aerosol-generating substrate is from about 1.5 to about 4.0, preferably from about 2.0 to about 3.5, more preferably from about 2.5 to about 3.0.

In a particularly preferred embodiments, a ratio between the length of the downstream section and the length of the aerosol-generating substrate is about 2.75.

A ratio between the length of the downstream section and the overall length of the aerosol-generating article may be from about 0.1 to about 1.5.

Preferably, a ratio between the length of the downstream section and the overall length of the aerosol-generating article is at least about 0.25, more preferably at least about 0.50. A ratio between the length of the downstream section and the overall length of the aerosol-generating article is preferably less than about 1.25, more preferably less than about 1.0.

In some embodiments, a ratio between the length of the downstream section and the overall length of the aerosol-generating article is preferably from about 0.25 to about 1.25, more preferably from about 0.5 to about 1.0.

In a particularly preferred embodiment, a ratio between the length of the downstream section and the overall length of the aerosol-generating article is about 0.73 or about 0.64.

The length of the downstream section may be composed of the sum of the lengths of the individual components forming the downstream section.

The RTD of the downstream section may be no more than about 100 mm $H_2O$. For example, the RTD of the downstream section may be no more than about 50 mm $H_2O$, no more than about 25 mm $H_2O$, no more than about 15 mm $H_2O$, no more than about 10 mm $H_2O$, no more than about 8 mm $H_2O$, no more than about 5 mm $H_2O$, or no more than about 1 mm $H_2O$.

The downstream section may comprise an unobstructed airflow pathway from the downstream end of the aerosol-generating substrate to the downstream end of the downstream section.

The unobstructed airflow pathway from the downstream end of the aerosol-generating substrate to the downstream end of the downstream section has a minimum diameter of about 0.5 millimetres. For example, the unobstructed airflow pathway may have a minimum diameter of 1 millimetre, 2 millimetres, 3 millimetres, or 5 millimetres.

The downstream section may comprise a hollow tubular element.

The provision of a hollow tubular element may advantageously provide a desired overall length of the aerosol-generating article without increasing the resistance to draw unacceptably.

The hollow tubular element may extend from the downstream end of the downstream section to the upstream end of the downstream section. In other words, the entire length of the downstream section may be accounted for by the hollow tubular element. Where this is the case, it will be appreciated that the lengths and length ratios set out above in relation to the downstream section are equally applicable to the length of the hollow tubular element.

The hollow tubular element may abut the downstream end of the aerosol-generating article.

The hollow tubular element may be spaced apart from the downstream end of the aerosol-generating article. Where this is the case, there may be an empty space between the downstream end of the aerosol-generating substrate and the upstream end of the hollow tubular element.

The hollow tubular element may have an internal diameter. The hollow tubular element may have a constant internal diameter along the length of the hollow tubular element. The internal diameter of the hollow tubular element may vary along the length of the hollow tubular element.

The hollow tubular element may have an internal diameter of at least about 2 millimetres. For example, the hollow tubular element may have an internal diameter of at least about 4 millimetres, at least about 5 millimetres, or at least about 7 millimetres.

The provision of a hollow tubular element having an internal diameter as set out above may advantageously provide sufficient rigidity and strength to the hollow tubular element.

The hollow tubular element may have an internal diameter of no more than about 10 millimetres. For example, the hollow tubular element may have an internal diameter of no more than about 9 millimetres, no more than about 8 millimetres, or no more than about 7.5 millimetres.

The provision of a hollow tubular element having an internal diameter as set out above may advantageously reduce the resistance to draw of the hollow tubular element.

The hollow tubular element may have an internal diameter of between about 2 millimetres and about 10 millimetres, between about 4 millimetres and about 9 millimetres, between about 5 millimetres and about 8 millimetres, or between about 7 millimetres and about 7.5 millimetres.

The hollow tubular element may have an internal diameter of about 7.1 millimetres.

The ratio between an internal diameter of the hollow tubular element and the external diameter of the hollow tubular element may be at least about 0.8. For example, the ratio between an internal diameter of the hollow tubular element and the external diameter of the hollow tubular element may be at least about 0.85, at least about 0.9, or at least about 0.95.

The ratio between an internal diameter of the hollow tubular element and the external diameter of the hollow tubular element may be no more than about 0.99. For example, the ratio between an internal diameter of the hollow tubular element and the external diameter of the hollow tubular element may be no more than about 0.98.

The ratio between an internal diameter of the hollow tubular element and the external diameter of the hollow tubular element may be about 0.97.

The provision of relatively large internal diameter may advantageously reduce the resistance to draw of the hollow tubular element.

The lumen of the hollow tubular element may have any cross sectional shape. The lumen of the hollow tubular element may have a circular cross sectional shape.

The hollow tubular element may be formed from any material. For example, the hollow tubular element may comprise cellulose acetate tow. Where the hollow tubular element comprises cellulose acetate tow, the hollow tubular element may have a thickness of between about 0.1 millimetre and about 1 millimetre. The hollow tubular element may have a thickness of about 0.5 millimetres.

Where the hollow tubular element comprises cellulose acetate tow, the cellulose acetate tow may have a denier per filament of between about 2 and about 4 and a total denier of between about 25 and about 40.

The hollow tubular element may comprise paper. The hollow tubular element may comprise at least one layer of paper. The paper may be very rigid paper. The paper may be crimped paper, such as crimped heat resistant paper or crimped parchment paper. The paper may be cardboard. The hollow tabular segment may be paper tube. The hollow tubular element may be a tube formed from spirally wound paper. The hollow tabular segment may be formed from a plurality of layers of the paper. The paper may have a basis weight of at least about 50 grams per square meter, at least about 60 grams per square meter, at least about 70 grams per square meter, or at least about 90 grams per square meter.

Where the tubular element comprises paper, the paper may have a thickness of at least about 50 micrometres. For example, the paper may have a thickness of at least about 70 micrometres, at least about 90 micrometres, or at least about 100 micrometres.

The hollow tubular element may comprise a polymer. For example, the hollow tubular element may comprise a polymeric film. The polymeric film may comprise a cellulosic film. The hollow tubular element may comprise low density polyethylene (LDPE) or polyhydroxyalkanoate (PHA) fibres.

The downstream section may comprise a modified tubular element. The modified tubular element may be provided instead of a hollow tubular element. The modified tubular element may be provided immediately downstream of the aerosol-generating substrate. The modified tubular element may abut the aerosol-generating substrate.

The modified tubular element may comprise a tubular body defining a cavity extending from a first upstream end of the tubular body to a second downstream end of the tubular body. The modified tubular element may also comprise a folded end portion forming a first end wall at the first upstream end of the tubular body. The first end wall may delimit an opening which permits airflow between the cavity and the exterior of the modified tubular element. Preferably, the opening is configured to allow airflow from the aerosol-generating substrate through the opening and into the cavity.

The cavity of the tubular body may be substantially empty to allow substantially unrestricted airflow along the cavity. The RTD of the modified tubular element may be localised at a specific longitudinal position of the modified tubular element. In particular, the RTD of the modified tubular element may be localised at the first end wall. In this way, the RTD of the modified tubular element may be substantially controlled through the chosen configuration of the first end wall and its corresponding opening. The RTD of the modified tubular element (which is essentially the RTD of the first end wall) may be about 5 millimetres $H_2O$.

The modified tubular element may have any length. The modified tubular element may have a length of between about 10 millimetres and about 60 millimetres, between about 15 millimetres and about 50 millimetres, between about 20 millimetres and about 55 millimetres, between about 25 millimetres and about 40 millimetres, or between about 30 millimetres and about 35 millimetres. For example, the modified tubular element may have a length of about 33 millimetres.

The modified tubular element may have any external diameter ($D_E$). The modified tubular element may have an external diameter ($D_E$) of between about 5 millimetres and about 12 millimetres, between about 6 millimetres and about 12 millimetres, or between about 7 millimetres and about 12 millimetres. The modified tubular element may have an external diameter ($D_E$) of about 7.3 millimetres.

The modified tubular element may have any internal diameter ($D_I$). The modified tubular element may have an internal diameter ($D_I$) of between about 2 millimetres and about millimetres, between about 4 millimetres and about 9 millimetres, between about 5 millimetres and about 8 millimetres, or between about 7 millimetres and about 7.5 millimetres. The modified tubular element may have an internal diameter ($D_I$) of about 7.1 millimetres.

The modified tubular element may have a peripheral wall having any thickness. The peripheral wall of the modified tubular element may have a thickness of between about 0.05 millimetres and about 0.5 millimetres. The peripheral wall of the modified tubular element may have a thickness of about 0.1 millimetres.

The downstream section may include ventilation. The ventilation may be provided to allow cooler air from outside the aerosol-generating article to enter the interior of the downstream section.

The aerosol-generating article may typically have a ventilation level of at least about percent, preferably at least about 20 percent.

In preferred embodiments, the aerosol-generating article has a ventilation level of at least about 20 percent or 25 percent or 30 percent. More preferably, the aerosol-generating article has a ventilation level of at least about 35 percent.

The aerosol-generating article preferably has a ventilation level of less than about 80 percent. More preferably, the aerosol-generating article has a ventilation level of less than about 60 percent or less than about 50 percent.

The aerosol-generating article may typically have a ventilation level of between about percent and about 80 percent.

In some embodiments, the aerosol-generating article has a ventilation level from about percent to about 80 percent, preferably from about 20 percent to about 60 percent, more preferably from about 20 percent to about 50 percent. In other embodiments, the aerosol-generating article has a ventilation level from about 25 percent to about 80 percent, preferably from about 25 percent to about 60 percent, more preferably from about 25 percent to about 50 percent. In further embodiments, the aerosol-generating article has a ventilation level from about 30 percent to about 80 percent, preferably from about 30 percent to about 60 percent, more preferably from about 30 percent to about 50 percent.

In particularly preferred embodiments, the aerosol-generating article has a ventilation level from about 40 percent to about 50 percent. In some particularly preferred embodiments, the aerosol-generating article has a ventilation level of about 45 percent.

Without wishing to be bound by theory, the inventors have found that the temperature drop caused by the admission of cooler, external air into the hollow tubular element may have an advantageous effect on the nucleation and growth of aerosol particles.

Formation of an aerosol from a gaseous mixture containing various chemical species depends on a delicate interplay between nucleation, evaporation, and condensation, as well as coalescence, all the while accounting for variations in vapour concentration, temperature, and velocity fields. The so-called classical nucleation theory is based on the assumption that a fraction of the molecules in the gas phase are large enough to stay coherent for long times with sufficient probability (for example, a probability of one half). These molecules represent some kind of a critical, threshold molecule clusters among transient molecular aggregates, meaning that, on average, smaller molecule clusters are likely to disintegrate rather quickly into the gas phase, while larger clusters are, on average, likely to grow. Such critical cluster is identified as the key nucleation core from which droplets are expected to grow due to condensation of molecules from the vapour. It is assumed that virgin droplets that just nucleated emerge with a certain original diameter, and then may grow by several orders of magnitude. This is facilitated and may be enhanced by rapid cooling of the surrounding vapour, which induces condensation. In this connection, it helps to bear in mind that evaporation and condensation are two sides of one same mechanism, namely gas-liquid mass transfer. While evaporation relates to net mass transfer from the liquid droplets to the gas phase, condensation is net mass transfer from the gas phase to the droplet phase. Evaporation (or condensation) will make the droplets shrink (or grow), but it will not change the number of droplets.

In this scenario, which may be further complicated by coalescence phenomena, the temperature and rate of cooling can play a critical role in determining how the system responds. In general, different cooling rates may lead to significantly different temporal behaviours as concerns the formation of the liquid phase (droplets), because the nucleation process is typically nonlinear. Without wishing to be bound by theory, it is hypothesised that cooling can cause a rapid increase in the number concentration of droplets, which is followed by a strong, short-lived increase in this growth (nucleation burst). This nucleation burst would appear to be more significant at lower temperatures. Further, it would appear that higher cooling rates may favour an earlier onset of nucleation. By contrast, a reduction of the cooling rate would appear to have a favourable effect on the final size that the aerosol droplets ultimately reach.

Therefore, the rapid cooling induced by the admission of external air into the hollow tubular element can be favourably used to favour nucleation and growth of aerosol droplets. However, at the same time, the admission of external air into the hollow tubular element has the immediate drawback of diluting the aerosol stream delivered to the consumer.

The inventors have surprisingly found that the diluting effect on the aerosol-which can be assessed by measuring, in particular, the effect on the delivery of aerosol former (such as glycerol) included in the aerosol-generating substrate) is advantageously minimised when the ventilation level is within the ranges described above. In particular, ventilation levels between 25 percent and 50 percent, and even more preferably between 28 and 42 percent, have been found to lead to particularly satisfactory values of glycerin delivery. At the same time, the extent of nucleation and, as a consequence, the delivery of nicotine and aerosol-former (for example, glycerol) are enhanced.

The ventilation into the downstream section may be provided along substantially the entire length of the downstream section. Where this is the case, the downstream section may comprise a porous material which allows air to enter the downstream section. For example, where the downstream section comprises a hollow tubular element, the hollow segment may be formed from a porous material which allows air to enter the interior of the hollow tubular element. Where the downstream section comprises a wrapper, the wrapper may be formed from a porous material which allows air to enter the interior of the hollow tubular element.

The downstream section may comprise a first ventilation zone for providing ventilation into the downstream section. The first ventilation zone comprises a portion of the downstream section through which a greater volume of air may pass compared to the remainder of the downstream section. For example, the first ventilation zone may be a portion of the downstream section having a higher porosity than the remainder of the downstream section.

The first ventilation zone may comprise a porous portion of the downstream section having a ventilation of at least 5 percent. For example, the first ventilation zone may comprise a porous portion of the downstream section having a ventilation of at least 10 percent, at least percent, at least 25 percent, at least 30 percent, or at least 35 percent.

The first ventilation zone may comprise a porous portion of the downstream section having a ventilation of no more than 80 percent. For example, the first ventilation zone may comprise a porous portion of the downstream section having a ventilation of no more than 60 percent, or less than 50 percent.

The first ventilation zone may comprise a porous portion of the downstream section having a ventilation of between 10 percent and 80 percent, between 20 percent and 80 percent, between 20 percent and 60 percent, or from 20 percent and 50 percent. In other embodiments, the first ventilation zone may comprise a porous portion of the downstream section having a ventilation of between 25 percent and 80 percent, between 25 percent and 60 percent, or between 25 percent and 50 percent. In further embodiments, the first ventilation zone may comprise a porous portion of the downstream section having a ventilation of between 30 percent and 80 percent, between 30 percent and 60 percent, or between 30 percent and 50 percent.

The first ventilation zone may comprise a porous portion of the downstream section having a ventilation of between 40 percent and 50 percent. In some particularly preferred embodiments, first ventilation zone may comprise a porous portion of the downstream section having a ventilation of 45 percent.

The first ventilation zone may comprise a first line of perforation holes circumscribing the downstream section.

In some embodiments, the first ventilation zone may comprise two circumferential rows of perforation holes. For example, the perforation holes may be formed online during manufacturing of the aerosol-generating article. Each circumferential row of perforation holes may comprise between about 5 and about 40 perforations, for example each circumferential row of perforation holes may comprise between about 8 and about 30 perforations.

Where the aerosol-generating article comprises a combining plug wrap the ventilation zone preferably comprises at least one corresponding circumferential row of perforation holes provided through a portion of the combining plug wrap. These may also be formed online during manufacture of the smoking article. Preferably, the circumferential row or rows of perforation holes provided through a portion of the combining plug wrap are in substantial alignment with the row or rows of perforations through the downstream section.

Where the aerosol-generating article comprises a band of tipping paper, wherein the band of tipping paper extends over the circumferential row or rows of perforations in the downstream section, the ventilation zone preferably comprises at least one corresponding circumferential row of perforation holes provided through the band of tipping paper. These may also be formed online during manufacture of the smoking article. Preferably, the circumferential row or rows of perforation holes provided through the band of tipping paper are in substantial alignment with the row or rows of perforations through the downstream section.

The first line of perforation holes may comprise at least one perforation hole having a width of at least about 50 micrometres. For example, the first line of perforation holes may comprise at least one perforation hole having a width of at least about 65 micrometres, at least about 80 micrometres, at least about 90 micrometres, or at least about 100 micrometres.

The first line of perforation holes may comprise at least one perforation hole having a width no greater than about 200 micrometres. For example, the first line of perforation holes may comprise at least one perforation hole having a width no greater than about 175 micrometres, no greater than about 150 micrometres, no greater than about 125 micrometres, or no greater than about 120 micrometres.

The first line of perforation holes may comprise at least one perforation hole having a width of between about 50 micrometres and about 200 micrometres, between about 65 micrometres and about 175 micrometres, between about 90 micrometres and about 150 micrometres, or between about 100 micrometres and about 120 micrometres.

Where the perforation holes are formed from using laser perforation techniques, the width of the perforation holes may be determined by the focus diameter of the laser.

The first line of perforation holes may comprise at least one perforation hole having a length of at least about 400 micrometres. For example, the first line of perforation holes may comprise at least one perforation hole having a length of at least about 425 micrometres, at least about 450 micrometres, at least about 475 micrometres, or at least about 500 micrometres.

The first line of perforation holes may comprise at least one perforation hole having a length no greater than about 1 millimetre. For example, the first line of perforation holes may comprise at least one perforation hole having a length no greater than about 950 micrometres, no greater than about 900 micrometres, no greater than about 850 micrometres, or no greater than about 800 micrometres.

The first line of perforation holes may comprise at least one perforation hole having a length of between about 400 micrometres and about 1 millimetre, between about 425 micrometres and about 950 micrometres, between about 450 micrometres and about 900 micrometres, between about 475 micrometres and about 850 micrometres, or between about 500 micrometres and about 800 micrometres.

The first line of perforation holes may comprise at least one perforation hole having an opening area of at least about 0.01 millimetres squared. For example, the first line of perforation holes may comprise at least one perforation hole having an opening area of at least about 0.02 millimetres squared, at least about 0.03 millimetres squared, or at least about 0.05 millimetres squared.

The first line of perforation holes may comprise at least one perforation hole having an opening area of no more than about 0.5 millimetres squared. For example, the first line of perforation holes may comprise at least one perforation hole having an opening area of no more than about 0.3 millimetres squared, no more than about 0.25 millimetres squared, or no more than about 0.1 millimetres squared.

The first line of perforation holes may comprise at least one perforation hole having an opening area of between about 0.01 millimetres squared and about 0.5 millimetres squared, between about 0.02 millimetres squared and about 0.3 millimetres squared, between about 0.03 millimetres squared and about 0.25 millimetres squared, or between about 0.05 millimetres squared and about 0.1 millimetres squared. The first line of perforation holes may comprise at least one perforation hole having an opening area of between about 0.05 millimetres squared and about 0.096 millimetres squared.

The first the first ventilation zone may comprise a second line of perforation holes circumscribing the downstream section. The second line of perforation holes may have any of the properties set out above in relation to the first line of perforation holes.

As set out above, the aerosol-generating article may comprise a wrapper circumscribing at least a portion of the downstream section, the first ventilation zone may comprise a porous portion of the wrapper.

The wrapper may be a paper wrapper, and the first ventilation zone may comprise a portion of porous paper.

As set out above, the downstream section may comprise a hollow tubular element spaced apart from the downstream end of the aerosol-generating substrate. Where this is the case, the hollow tubular element may be connected to the aerosol-generating substrate by a paper wrapper. The wrapper may be a porous paper wrapper. Where this is the case, the first ventilation zone may comprise the portion of porous paper wrapper overlaying the space between the downstream end of the aerosol-generating substrate and the upstream end of the hollow tubular element. In this case, the upstream end of the first ventilation zone abuts the downstream end of the aerosol-generating substrate and the downstream end of the first ventilation zone abuts the upstream end of the hollow tubular element.

The porous portion of the wrapper forming the first ventilation zone may have a basis weight which is lower than that of a portion of the wrapper which does not form part of the first ventilation zone.

The porous portion of the wrapper forming the first ventilation zone may have a thickness which is lower than that of a portion of the wrapper which does not form part of the first ventilation zone.

The upstream end of the first ventilation zone may be less than 10 millimetres from the downstream end of the aerosol-generating substrate.

For example, the upstream end of the first ventilation zone may be less than 8 millimetres, less than 5 millimetres, less than 3 millimetres, or less than 1 millimetre from the from the downstream end of the aerosol-generating substrate.

The upstream end of the first ventilation zone may be longitudinally aligned with the downstream end of the aerosol-generating substrate.

The upstream end of the first ventilation zone may be located less than 25 percent of the way along the length of the downstream element from the downstream end of the aerosol-generating substrate. For example, the upstream end of the first ventilation zone may be located less than 20 percent, less than 18 percent, less than 15 percent, less than 10 percent, less than 5 percent, or less than 1 percent of the way along the length of the downstream element from the downstream end of the aerosol-generating substrate.

The downstream end of the first ventilation zone may be located less than 30 percent of the way along the length of the downstream element from the downstream end of the aerosol-generating substrate. For example, the downstream end of the first ventilation zone may be located less than 25 percent, less than 20 percent, less than 18 percent, less than 15 percent, less than 10 percent, or less than 5 percent of the way along the length of the downstream element from the downstream end of the aerosol-generating substrate.

The downstream end of the first ventilation zone may be less than 10 millimetres from the downstream end of the aerosol-generating substrate. In other words, the first ventilation zone may be entirely located within 10 millimetres of the aerosol-generating substrate.

For example, the downstream end of the first ventilation zone may be less than 8 millimetres, less than 5 millimetres, or less than 3 millimetres from the downstream end of the aerosol-generating substrate.

The first ventilation zone may be located anywhere along the length of the downstream section. The downstream end of the first ventilation zone may be located no more than about millimetres from the downstream end of the aerosol-generating article. For example, the first ventilation zone may be located no more than about 20 millimetres from the downstream end of the aerosol-generating article.

Locating the first ventilation zone as outlined above may advantageously prevent the first ventilation zone being occluded when the aerosol-generating article is inserted into an aerosol-generating device.

The downstream end of the first ventilation zone may be located at least about 8 millimetres from the downstream end of the aerosol-generating article. For example, the downstream end of the first ventilation zone may be located at least about 10 millimetres, at least 12 millimetres, or at least about 15 millimetres from the downstream end of the aerosol-generating article.

Locating the first ventilation zone as outlined above may advantageously prevent the first ventilation zone being occluded by a user's mouth or lips when the aerosol-generating article is in use.

The downstream end of the first ventilation zone may be located between about 8 millimetres and about 25 millimetres, between about 10 millimetres and about 25 millimetres, or between about 15 millimetres and about 20 millimetres from the downstream end of the aerosol-generating article. The downstream end of the first ventilation zone may be located about 18 millimetres from the downstream end of the aerosol-generating article.

The upstream end of the first ventilation zone may be located at least about 20 millimetres from the upstream end of the aerosol-generating article. For example, the upstream end of the first ventilation zone may be located at least about 25 millimetres from the upstream end of the aerosol-generating article.

Locating the first ventilation zone as outlined above may advantageously prevent the first ventilation zone being occluded when the aerosol-generating article is inserted into an aerosol-generating device.

The upstream end of the first ventilation zone may be located no more than 37 millimetres from the upstream end of the aerosol-generating article. For example, the upstream end of the first ventilation zone may be located no more than about 30 millimetres from the upstream end of the aerosol-generating article.

Locating the first ventilation zone as outlined above may advantageously prevent the first ventilation zone being occluded by a user's mouth or lips when the aerosol-generating article is in use.

The upstream end of the first ventilation zone may be located between about 20 millimetres and about 37 millimetres, or between about 25 millimetres and about 30 millimetres from the upstream end of the aerosol-generating article. The upstream end of the first ventilation zone may be located about 27 millimetres from the downstream end of the aerosol-generating article.

The first ventilation zone may have any length. The first ventilation zone may have a length of at least 0.5 millimetres. In other words, the longitudinal distance between the downstream end of the first ventilation zone and the an upstream end of the first ventilation zone is at least 0.5 millimetres. For example, the first ventilation zone may have a length of at least 1 millimetre, at least 2 millimetres, at least 5 millimetres, or at least 8 millimetres.

The first ventilation zone may have a length of no more than 10 millimetres. For example, the first ventilation zone may have a length of no more than 8 millimetres, or no more than 5 millimetres.

The first ventilation zone may have a length of between 0.5 millimetres and 10 millimetres. For example, the first ventilation zone may have a length of between 1 millimetre and 8 millimetres, or between 2 millimetres and 5 millimetres.

The aerosol-generating article may further comprise a further element or component in addition to the hollow tubular element and the aerosol-generating element, such as a filter segment or mouthpiece segment. More preferably, the downstream section of the aerosol-generating article may comprise an element or component in addition to the hollow tubular element, such as a filter segment or mouthpiece segment.

Such a further element may be located downstream of the hollow tubular element. Such a further element may be located immediately downstream of the hollow tubular element. Such a further element may be located between the aerosol-generating element and the hollow tubular element. Such a further element may extend from the downstream end of the hollow tubular element to the mouth end of the aerosol-generating article or to the downstream end of the downstream section. Such a further element is preferably a downstream element or segment. Such a further element may be a filter element or segment or a mouthpiece segment.

Such a further element may form part of the downstream section of the aerosol-generating article of the present disclosure. Such a further element may be in axial alignment with the rest of the components of the aerosol-generating article, such as the aerosol-generating element and the hollow tubular element. Furthermore, the further element may have a similar diameter to the outer diameter of the hollow tubular element, the diameter of the aerosol-generating element or the diameter of the aerosol-generating article.

The aerosol-generating article of the present disclosure preferably comprises a wrapper circumscribing the downstream section (or the components of the downstream section). Such a wrapper may be an outer tipping wrapper that circumscribes the downstream section and a portion of the aerosol-generating element, such that the downstream section is attached to the aerosol-generating element.

The downstream section of the aerosol-generating article of the present disclosure may define a recessed cavity.

The above described "further element" may be also be referred to in the present disclosure as a "first section" or "first segment" of the "downstream section". The terms "first segment" or "further element" may alternatively be referred to in the present disclosure as a "mouthpiece segment", a "retaining segment", a "downstream segment", a "mouthpiece element", a "downstream element", a "retaining element", a "filter element" or a "filter segment" or a "downstream plug element". The term "mouthpiece" may refer to an element of the aerosol-generating article that is located downstream of the aerosol-generating element of the aerosol-generating article, preferably in the vicinity of the mouth end of the article.

As mentioned above, between about 5 and about 35 percent of the length of the downstream section may comprise a first section defining a first empty region for air to flow and at least about 65 percent of the length of the downstream section may comprise a second section defining a second empty region for air to flow, where a total cross-sectional area of the first empty region defined by the first section may be less than a total cross-sectional area of the second empty region defined by the second section. The inventors have found that such a longitudinal distribution of the first and second empty regions within the downstream section ensures that a relatively low RTD of the downstream section is achieved, while providing a downstream component (the first section) that does not increase the RTD significantly and provides a physical barrier that may prevent any dislodged material from the aerosol-generating element during normal use from inadvertently exiting the mouth end of the aerosol-generating article.

The term "empty region" refers to a region or space through which air may flow. For example, a hollow tubular element may define a cavity, which provides an empty region. A further segment may comprise a plurality of air flow channels defined through the segment and such plurality of air flow channels may define an empty region within the further segment for air to flow through. A filter or retaining segment, in accordance with the present disclosure, may also provide an empty region that is defined by a plurality of gaps for air to flow through provided within the material forming the filter or retaining segment.

The first section, or portion, of the downstream section refers to a section, a portion or a component of the downstream section that defines the first empty region or space. Equally, the second section, or portion, of the downstream section refers to a section, a portion or a component of the downstream section that defines the second empty region or space.

The first section of the downstream section may comprise one or more first segments, in line with the present disclosure. The first segment may comprise at least one segment air flow channel extending along a longitudinal direction of the first segment. The first empty region may be defined by the at least one (first) segment air flow channel. The at least one segment air flow channel may be defined within and by the first section of the downstream section. In other words, where the first section comprises a first segment, the at least one segment air flow channel may be defined internally within and along the first segment of the downstream section. As discussed above, the first segment of the downstream section may comprise a mouthpiece segment. Preferably, the at least one segment air flow channel extends along the entire length of the first segment, extending for the upstream end of the first segment to the downstream end of the first segment.

The second empty region may comprise at least one cavity. The at least one cavity may provide an unrestricted air flow channel extending along the longitudinal direction of the aerosol-generating article. The second section of the downstream section may comprise a second segment. The second segment may be a hollow tubular element in accordance with the present disclosure. The second section of the downstream section may comprise at one hollow tubular element. The second empty region may be defined by at least one hollow tubular element. Providing the majority of the length of the downstream section with the at least one hollow tubular element ensures that a relatively low RTD of the downstream section, and the aerosol-generating article as a whole, is achieved.

The downstream section may comprise a second section comprising two hollow tubular elements and a first section comprising a first segment. The second empty region may be defined by the two hollow tubular elements. The first section may be located between the two hollow tubular elements. The two hollow tubular elements may be of different lengths or substantially the same length to each other. In such an example, the two cavities defined by the two hollow tubular elements (together) define the second empty region. The second empty region may be divided into a plurality of empty regions.

Alternatively, the downstream section may comprise a second section comprising a hollow tubular element and a first section comprise at least one first segment. The hollow tubular element may extend from downstream end of the aerosol-generating element to the mouth end of the aerosol-generating article. The at least one first segment of the first section may be positioned within and along the hollow tubular element. The at least one first segment may therefore divide the cavity defined by the hollow tubular element into two cavity portions, one upstream of the at least one first segment and another downstream of the at least one first segment. The at least one first segment forming the first section of the downstream section may define the first empty region and the two cavity portions defined on either side of the at least one first segment may form the second section of the downstream section and may define the second empty region. The most downstream one of the cavity portions may define a recess cavity extending from a downstream end of the at least one first segment to the mouth end of the aerosol-generating article and the most upstream one of the cavity portions may define a cavity between the upstream end of the at least one first segment (or first section) and the downstream end of the aerosol-generating element (also considered to be the upstream end of the downstream section).

The first segment may be located near the mouth end of the aerosol-generating article. The first segment may extend to the mouth end of the aerosol-generating article. The first segment may extend from the downstream end of the second section, which may comprise a hollow tubular element, to the mouth end of the aerosol-generating article. Alternatively, the first segment may be located upstream of the mouth end of the aerosol-generating article. Preferably, the first segment may be located downstream of any ventilation zones or ventilation lines provided in the downstream section. Preferably, the first segment is located in the downstream half of the downstream section. The downstream half of the downstream section refers to a portion of the downstream section extending from middle or centre of the downstream section to the mouth end or downstream end of the downstream section. Thus, the length of the downstream half of the downstream section may equate to 50 percent of the length of the downstream section. Preferably, the first segment may be located at a position between a ventilation zone or line (or the most downstream ventilation zone or line) and the mouth end of the article.

Providing a first segment of the first section at or near the mouth end of the aerosol-generating article provides structural rigidity and integrity in the downstream portion of the downstream section, the majority of which may comprise at least one hollow tubular element that defines a cavity (or second empty region), while also allowing a certain amount of air to flow through by providing a first empty region to maintain a relatively low RTD of the aerosol-generating article and providing a physical barrier that prevents any dislodged portions of the aerosol-generating element from exiting the aerosol-generating article via the mouth end.

The upstream end of a first segment of the first section may be located about 18 mm or less downstream from the downstream end of the downstream section. The upstream end of the first segment of the first section may be located about 15 mm or less downstream from the downstream end of the downstream section. The upstream end of the first segment of the first section may be located about 12 mm or less downstream from the downstream end of the downstream section. The upstream end of a first segment of the first section may be located at least about 0 mm downstream from the most downstream ventilation zone or line. The upstream end of a first segment of the first section may be located at least about 1 mm downstream from the most downstream ventilation zone or line. The upstream end of a first segment of the first section may be located at least about 2 mm downstream from the most downstream ventilation zone or line.

Alternatively, a first segment may be located upstream of any ventilation zones or ventilation lines provided in the downstream section. The first segment may be located in the upstream half of the downstream section. The upstream half of the downstream section refers to a portion of the downstream section extending from middle or centre of the downstream section to the upstream end of the downstream section. Thus, the length of the upstream half of the downstream section may equate to 50 percent of the length of the downstream section. The first segment may be located at a position between a ventilation zone or line (or the most upstream ventilation zone or line) and the downstream end of the aerosol-generating element.

The diameter of a first segment (or first section) may be substantially the same as the outer diameter of the hollow tubular element. As mentioned in the present disclosure, the outer diameter of the hollow tubular element may be about 7.3 mm.

The diameter of the first segment may be between about 5 mm and about 10 mm. The diameter of the first segment may be between about 6 mm and about 8 mm. The diameter of the first segment may be between about 7 mm and about 8 mm. The diameter of the first segment may be about 7.3 mm.

Alternatively, the diameter of a first segment (or first section) may be substantially the same as the inner diameter of the at least one hollow tubular element of the second section. In other words, the diameter of the first section may be the same as an inner diameter of the second section. As mentioned in the present disclosure, the inner diameter of a hollow tubular element may be 7.1 mm. The diameter of the first segment may be about 7.1 mm. The first segment may instead be located within a hollow tubular element of the second section of the downstream section. The first segment may therefore be circumscribed by the wall of the hollow tubular element, preferably in an airtight manner such that air may not flow between the interior surface of the hollow tubular element and the first segment and may only flow through the first segment.

Alternatively, between about 5 and about 30 percent of the length of the downstream section may comprise the first section defining the first empty region for air to flow and at least about 70 percent of the length of the downstream section may comprise the second section defining the second empty region for air to flow. More preferably, between about 5 and about percent of the length of the downstream section may comprise the first section defining the first empty region for air to flow and at least about 75 percent of the length of the downstream section may comprise the second section defining the second empty region for air to flow. Even more preferably, between about 5 and about 20 percent of the length of the downstream section may comprise the first section defining the first empty region for air to flow and at least about 80 percent of the length of the downstream section may comprise the second section defining the second empty region for air to flow. Alternatively, between about 5 and about 15 percent of the length of the downstream section may comprise the first section defining the first empty region for air to flow and at least about 85 percent of the length of the downstream section may comprise the second section defining the second empty region for air to flow. Preferably, between about 5 and about 10 percent of the length of the downstream section may comprise the first section defining the first empty region for air to flow and at least about 90 percent of the length of the downstream section may comprise the second section defining the second empty region for air to flow.

Unless otherwise specified, the resistance to draw (RTD) of a component or the aerosol-generating article is measured in accordance with ISO 6565-2015. The RTD refers the pressure required to force air through the full length of a component. The terms "pressure drop" or "draw resistance" of a component or article may also refer to the "resistance to draw". Such terms generally refer to the measurements in accordance with ISO 6565-2015 are normally carried out at under test at a volumetric flow rate of about 17.5 millilitres per second at the output or downstream end of the measured component at a temperature of about 22 degrees Celsius, a pressure of about 101 kPa (about 760 Torr) and a relative humidity of about 60%.

The resistance to draw per unit length of a particular component (or element) of the aerosol-generating article, such as the downstream section, the first section or the first segment, can be calculated by dividing the measured resistance to draw of the component by the total axial length of the component. The RTD per unit length refers to the pressure required to force air through a unit length of a component. Throughout the present disclosure, a unit length refers to a length of 1 mm. Accordingly, in order to derive the RTD per unit length of a particular component, a specimen of a particular length, 15 mm for example, of the component can be used in measurement. The RTD of such a specimen is measured in accordance with ISO 6565-2015. If, for example, the measured RTD is about 15 mm $H_2O$, then the RTD per unit length of the component is about 1 mm $H_2O$ per mm. The RTD per unit length of the component is dependent on the structural properties of the material used for the component as well as the cross-sectional geometry or profile of the component, amongst other factors.

The relative RTD, or RTD per unit length, of the downstream section may be between about 0 mm $H_2O$ per mm and about 3 mm $H_2O$ per mm. The RTD per unit length of the downstream section may be between about 0 mm $H_2O$ per mm and about 0.75 mm $H_2O$ per mm.

As mentioned above, the relative RTD, or RTD per unit length, of the downstream section may be greater than about 0 mm $H_2O$ per mm and less than about 3 mm $H_2O$ per mm. The RTD per unit length of the downstream section may be greater than about 0 mm $H_2O$ per mm and less than about 0.75 mm $H_2O$ per mm.

The RTD per unit length of the downstream section may be greater or equal to about 0 mm $H_2O$ per mm. Thus, the RTD per unit length of the downstream section may be between about 0 mm $H_2O$ per mm and about 3 mm $H_2O$ per mm. The RTD per unit length of the downstream section may be between about 0 mm $H_2O$ per mm and about 0.75 mm $H_2O$ per mm.

The resistance to draw of the downstream section may be greater than or equal to about 0 mm $H_2O$ and less than about 10 mm $H_2O$. The resistance to draw of the downstream section may be greater than 0 mm $H_2O$ and less than about 1 mm $H_2O$.

The resistance to draw (RTD) characteristics of the downstream section may be wholly or mostly attributed to the RTD characteristics of the first section of the downstream section. In other words, the RTD of the first section of the downstream section may wholly define the RTD of the downstream section.

The relative RTD, or RTD per unit length, of the first section (or the at least first segment defining the first section) may be between about 0 mm $H_2O$ per mm and about 3 mm $H_2O$ per mm. The RTD per unit length of the first section may be between about 0 mm $H_2O$ per mm and about 0.75 mm $H_2O$ per mm.

As mentioned above, the relative RTD, or RTD per unit length, of the first section may be greater than about 0 mm $H_2O$ per mm and less than about 3 mm $H_2O$ per mm. The RTD per unit length of the first section may be greater than about 0 mm $H_2O$ per mm and less than about 0.75 mm $H_2O$ per mm.

The RTD per unit length of the first section may be greater or equal to about 0 mm $H_2O$ per mm. Thus, the RTD per unit length of the first section may be between about 0 mm $H_2O$ per mm and about 3 mm $H_2O$ per mm. The RTD per unit length of the first section may be between about 0 mm $H_2O$ per mm and about 0.75 mm $H_2O$ per mm.

The resistance to draw of the first section (or a first segment forming the first section) may be greater than or equal to about 0 mm $H_2O$ and less than about 10 mm $H_2O$. The resistance to draw of the first section may be greater than 0 mm $H_2O$ and less than about 1 mm $H_2O$.

The first segment may comprise at least one segment (air flow) channel extending along the first segment. The segment air flow channel may also be referred to a segment air flow channel throughout the present disclosure. The provision of at least one segment air flow channel in the first segment allows the downstream section to provide a relatively low RTD by allowing air to flow through, while ensuring the first segment provides a physical barrier to prevent inadvertent exit of aerosol-generating element material from mouth end of the aerosol-generating article. As mentioned in the present disclosure, the aerosol-generating element material may comprise plant cut filler, particularly tobacco cut filler.

A ratio of the total cross-sectional area of the at least one segment channel to the total cross-sectional area of the first segment (or first section) of the downstream section, may be at least about 5%. In other words, the open area or first empty region defined by the first segment may have a total cross-sectional area that is least about 5% of the total cross-sectional area of the first segment. The total cross-sectional area of the first segment, the first section, the second section, the downstream section, the aerosol-generating element or the aerosol-generating article may be the same as a cross-sectional area calculated based on the corresponding outer diameters of the first segment, the first section, the second section, the downstream section, the aerosol-generating element or the aerosol-generating article. The total cross-sectional area of a component, in the present disclosure, refers to the total area within an outer perimeter of a (transverse) cross-section of such a component. For example, the total cross-sectional area of a cylindrical component may be equal to the area of a circular cross-section calculated based on the outer diameter of the cylindrical component, that is, the amount of area the cross-section of the component occupies. As another example, in the present disclosure, the total cross-sectional area of a hollow tubular element may be equal to the area of a circular cross-section calculated based on the outer diameter of the hollow tubular element. The total cross-sectional area of the first empty region may be the same as the sum of the cross-sectional areas of each of the at least one segment channel defined by a first segment of the first section of the downstream section.

A ratio of the total cross-sectional area of the at least one segment channel (of the first segment) to the total cross-sectional area of the first segment (or section) may be at least about 10%. A ratio of the total cross-sectional area of the at least one segment channel (of the first segment) to the total cross-sectional area of the first segment (or section) may be at least about 30%. A ratio of the total cross-sectional area of the at least one segment channel (of the first segment) to the total cross-sectional area of the first segment (or section) may be at least about 40%. A ratio of the total cross-sectional area of the at least one segment channel to the total cross-sectional area of the first segment may be at least about 65%. A ratio of the total cross-sectional area of the at least one segment channel to the total cross-sectional area of the first segment may be at least about 70%. In addition, the first segment may itself be porous. Providing a large proportion of segment channels, or open area, empty space or empty region, ensures that the RTD, and RTD per unit length, of the first segment and the downstream section is beneficially low, while ensuring there is enough material of the first segment to hinder any portions of the aerosol-generating element from escaping the article.

A ratio of the total cross-sectional area of the at least one segment channel to the total cross-sectional area of the first segment may be at most about 95%. A ratio of the total cross-sectional area of the at least one segment channel to the total cross-sectional area of the first segment may be at most about 85%. A ratio of the total cross-sectional area of the at least one segment channel to the total cross-sectional area of the first segment may be at most about 75%.

A ratio of the total cross-sectional area of the second empty region to the total cross-sectional area of the second section of the downstream section may be at least about 25%. In other words, the open area defined by the second empty region of the downstream section may be at least about 25% of the total cross-sectional area of the second section of the downstream section, which may have a uniform cross-sectional area. Preferably, a total cross-sectional area of the first section of the downstream section is the same as a total cross-sectional area of the second section of the downstream section. Accordingly, the cross-sectional area of the downstream section may be substantially uniform.

A ratio of the total cross-sectional area of the second empty region to the total cross-sectional area of the downstream section may be at least about 50%. A ratio of the total cross-sectional area of the second empty region to the total cross-sectional area of the downstream section may be at least about 75%. A ratio of the total cross-sectional area of the second empty region to the total cross-sectional area of the downstream section may be at least about 80%. Providing a large proportion of open area or empty region, ensures that the RTD, and RTD per unit length, of the downstream section, and the aerosol-generating article as a whole, is beneficially low.

A ratio of the total cross-sectional area of the second empty region to the total cross-sectional area of the second section may be at most about 99%. A ratio of the total cross-sectional area of the second empty region to the total cross-sectional area of the second section may be at most about 95%. A ratio of the total cross-sectional area of the second empty region to the total cross-sectional area of the second section may be at most about 90%.

A ratio of the total cross-sectional area of the second empty region to the total cross-sectional area of the first empty region, which may be defined by at least one segment air flow channel, may be above about 1.1 (110%), preferably above about 1.3 (130%), more preferably about 1.5 (150%) and even more preferably about 2 (200%).

An inner diameter or width of at least one segment air flow channel may be between about 1 mm and about 6 mm. An inner diameter or width of at least one segment air flow channel may be between about 2 mm and about 5 mm. An inner diameter or width of at least one segment air flow channel may be between about 3 mm and about 4 mm.

An inner diameter or width of at least one segment air flow channel (which defines the first empty region) may be less than an inner diameter of the air flow channel provided by the at least one cavity of the second empty region. As discussed above, the at least one cavity may be defined by at least one hollow tubular element, in accordance with the present disclosure. The hollow tubular element defining the second empty region may therefore have the same characteristics, such as the geometry, as the hollow tubular element defined in the present disclosure.

The first segment may be formed of a fibrous material. The first segment may be formed of a porous material. The first segment may be formed of a biodegradable material. The first segment may be formed of a cellulose material, such as cellulose acetate. For example, a first segment may be formed from a bundle of cellulose acetate fibres having a denier per filament between about 10 and about 15. For example, a first segment formed from relatively low density cellulose acetate tow, such as cellulose acetate tow comprising fibres of about 12 denier per filament, which may provide an RTD per unit length between about 0.8 and about 2.5 mm $H_2O$ per mm.

The first segment may be formed of a polylactic acid based material. The first segment may be formed of a bioplastic material, preferably a starch-based bioplastic material. The first segment may be made by injection moulding or by extrusion. Bioplastic-based materials are advantageous because they are able to provide first segment structures which are simple and cheap to manufacture with a particular and complex cross-sectional profile, which may comprise a plurality of relatively large air flow channels extending through the first segment material, that provides suitable RTD characteristics.

The first segment may be formed from a sheet of suitable material that has been crimped, pleated, gathered, woven or folded into an element that defines a plurality of longitudinally extending channels. Such sheet of suitable material may be formed of paper, cardboard, a polymer, such as polylactic acid, or any other cellulose-based, paper-based material or bioplastic-based material. A cross-sectional profile of such a first segment may show the channels as being randomly oriented.

The first segment may be formed in any other suitable manner. For example, the first segment may be formed from a bundle of longitudinally extending tubes. The longitudinally extending tubes may be formed from polylactic acid. The first segment may be formed by extrusion, moulding, lamination, injection, or shredding of a suitable material. Thus, it is preferred that there is a low-pressure drop (or RTD) from an upstream end of the first segment to a downstream end of the first segment.

The first segment may not consist of a hollow tubular element as defined in the present disclosure, which defines a single unobstructed air flow channel between its upstream and downstream ends. Such a hollow tubular element would effectively provide an RTD, and an RTD per unit length, of 0 mm $H_2O$.

The length of the first segment may at least be about 1 mm. The length of the first segment may not be greater than about 15 mm. The length of the first segment may be between about 1 mm and about 15 mm. The length of the first segment may be between about 5 millimetres and about 15 millimetres. Preferably, the length of the first segment may be between about 1 mm and about 10 mm. The length of the first segment may be about 6 mm. It is preferable that the length of the first section (or first segment of the first section) is less than the length of the second section of the downstream section, which may be defined by at least one hollow tubular element, such that the relatively low RTD characteristics of the downstream section are not affected by a relatively long first segment having a higher RTD than that of the second section or portion of the downstream section.

The upstream end of the aerosol-generating article may be defined by a wrapper. The provision of a wrapper at the upstream end of the aerosol-generating article may advantageously retain the aerosol-forming substrate in the aerosol-generating article. This feature may also advantageously prevent users from coming into direct contact with the aerosol-generating substrate.

The wrapper may be mechanically closed at the upstream end of the aerosol-generating article. This may be achieved by folding or twisting the wrapper. An adhesive may be used to close the upstream end of the aerosol-generating article.

The wrapper defining the upstream end of the aerosol-generating article may be formed from the same piece of material as the wrapper circumscribing at least a portion of the downstream section.

This provision may advantageously simplify manufacture of the aerosol-generating article since only one piece of wrapper material may be needed. In addition, the use of a single piece of wrapper material may remove the need for a seam to connect two pieces of wrapper material. This may advantageously simplify manufacture. The lack of a seam may also advantageously prevent or reduce any of the aerosol-generating substrate from leaking out of the aerosol-generating article.

The aerosol-generating article of the present invention further comprises an upstream section. The upstream section may comprise an upstream element upstream of the aerosol-generating substrate. The upstream element may extend from an upstream end of the aerosol-generating substrate to the upstream end of the aerosol-generating article. The upstream element may abut the upstream end of the aerosol-generating article.

The aerosol-generating article may comprise an air inlet at the upstream end of the aerosol-generating article. Where the aerosol-generating article comprises an upstream element, the air inlet may be provided through the upstream element. The air entering through the air inlet may pass into the aerosol-generating substrate in order to generate the mainstream aerosol.

The upstream section may have a high RTD.

In embodiments of the present invention where the downstream section has a relatively low RTD, for example an RTD of less than about 10 mm $H_2O$, the provision of an upstream section having a relatively high RTD may advantageously provide an acceptable overall RTD without the need for a high RTD element, such as a filter, downstream of the aerosol-generating substrate. In use, air enters the aerosol-generating article through the upstream end of the upstream section, passes through the upstream section and into the aerosol-generating substrate. The air then passes into and through the downstream section and then out of the downstream end of the downstream section.

The majority of the overall RTD of the aerosol-generating article may be accounted for by the RTD of the upstream section.

The ratio of the RTD of the upstream section to the RTD of the downstream section may be more than 1. For example, the ratio of the RTD of the upstream section to the RTD of the downstream section may be more than about 2, more than about 5, more than about 8, more than about 10, more than about 15, more than about 20, or more than about 50.

The RTD of the upstream section may be at least about 5 mm $H_2O$. For example, the RTD of the upstream section may be at least about 10 mm $H_2O$, at least about 12 mm $H_2O$, at least about 15 mm $H_2O$, at least about 20 mm $H_2O$.

The RTD of the upstream section may be no more than about 150 mm $H_2O$. For example, the RTD of the upstream section may be no more than about 100 mm $H_2O$, no more than about 80 mm $H_2O$, no more than about 70 mm $H_2O$, no more than about 60 mm $H_2O$, no more than about 50 mm $H_2O$, or no more than about 40 mm $H_2O$.

The RTD of the upstream section may be between about 5 mm $H_2O$ and about 80 mm $H_2O$. For example, the RTD of the upstream section may be between about 10 mm $H_2O$ and about 70 mm $H_2O$, between about 12 mm $H_2O$ and about 60 mm $H_2O$, between about 15 mm $H_2O$ and about 50 mm $H_2O$, or between about 20 mm $H_2O$ and about 40 mm $H_2O$.

The upstream section may advantageously prevent direct physical contact with the upstream end of the aerosol-generating substrate. In particular, where the aerosol-generating substrate comprises a susceptor element, the upstream section may prevent direct physical contact with the upstream end of the susceptor element. This helps to prevent the displacement or deformation of the susceptor element during handling or transport of the aerosol-generating article. This in turn helps to secure the form and position of the susceptor element. Furthermore, the presence of an upstream section may help to prevent any loss of the substrate, which may be advantageous, for example, if the substrate contains particulate plant material.

The upstream section may also provide an improved appearance to the upstream end of the aerosol-generating article. Furthermore, if desired, the upstream section may be used to provide information on the aerosol-generating article, such as information on brand, flavour, content, or details of the aerosol-generating device that the article is intended to be used with.

Where the upstream section comprises an upstream element, the upstream element may comprise a porous plug element. The porous plug element may have a porosity of at least about 50 percent in the longitudinal direction of the aerosol-generating article. More preferably, the porous plug element has a porosity of between about 50 percent and about 90 percent in the longitudinal direction. The porosity of the porous plug element in the longitudinal direction is defined by the ratio of the cross-sectional area of material forming the porous plug element and the internal cross-sectional area of the aerosol-generating article at the position of the porous plug element.

The porous plug element may be made of a porous material or may comprise a plurality of openings. This may, for example, be achieved through laser perforation. Preferably, the plurality of openings is distributed homogeneously over the cross-section of the porous plug element.

The porosity or permeability of the upstream element may advantageously be varied in order to provide a desirable overall resistance to draw of the aerosol-generating article.

In alternative embodiments, the upstream element may be formed from a material that is impermeable to air. In such embodiments, the aerosol-generating article may be configured such that air flows into the rod of aerosol-generating substrate through suitable ventilation means provided in a wrapper.

The upstream element may be made of any material suitable for use in an aerosol-generating article. For example, the upstream element may comprise a plug of material. Suitable materials for forming the upstream element include filter materials, ceramic, polymer material, cellulose acetate, cardboard, zeolite or aerosol-generating substrate. Preferably, the upstream element comprises a plug comprising cellulose acetate.

Where the upstream element comprises a plug of material, the downstream end of the plug of material may about the upstream end of the aerosol-generating substrate. For example, the upstream element may comprise a plug comprising cellulose acetate abutting the upstream end of the aerosol-generating substrate. This may advantageously help retain the aerosol-generating substrate in place.

Where the upstream element comprises a plug of material, the downstream end of the plug of material may be spaced apart from the upstream end of the aerosol-generating substrate. The upstream element may comprise a plug comprising fibrous filtration material.

Preferably, the upstream element is formed of a heat resistant material. For example, preferably the upstream element is formed of a material that resists temperatures of up to 350 degrees Celsius. This ensures that the upstream element is not adversely affected by the heating means for heating the aerosol-generating substrate.

Preferably, the upstream section has a diameter that is approximately equal to the diameter of the aerosol-generating article.

The upstream section may have a length of at least about 1 millimetre. For example, the upstream section may have a length of at least about 2 millimetres, at least about 4 millimetres, or at least about 6 millimetres.

The upstream section may have a length of no more than about 15 millimetres. For example, the upstream section may have a length of no more than about 12 millimetres, no more than about 10 millimetres, or no more than about 8 millimetres.

The upstream section may have a length of between about 1 millimetre and about 15 millimetres. For example, the upstream section may have a length of between about 2 millimetres and about 12 millimetres, between about 4 millimetres and about 10 millimetres, or between about 6 millimetres and about 8 millimetres.

The length of the upstream section can advantageously be varied in order to provide the desired total length of the aerosol-generating article. For example, where it is desired to reduce the length of one of the other components of the aerosol-generating article, the length of the upstream section may be increased in order to maintain the same overall length of the article.

The upstream section preferably has a substantially homogeneous structure. For example, the upstream section may be substantially homogeneous in texture and appearance. The upstream section may, for example, have a continuous, regular surface over its entire cross section. The upstream section may, for example, have no recognisable symmetries.

The upstream section may comprise a second tubular element. The second tubular element may be provided instead of an upstream element. The second tubular element may be provided immediately upstream of the aerosol-generating substrate. The second tubular element may abut the aerosol-generating substrate.

The second tubular element may comprise a tubular body defining a cavity extending from a first upstream end of the tubular body to a second downstream end of the tubular body. The second tubular element may also comprise a folded end portion forming a first end wall at the first upstream end of the tubular body. The first end wall may delimit an opening which permits airflow between the cavity and the exterior of the second tubular element. Preferably, air may flow from the cavity through the opening and into the aerosol-generating substrate.

The second tubular element may comprise a second end wall at the second end of its tubular body. This second end wall may be formed by folding an end portion of the second tubular element at the second downstream end of the tubular body. The second end wall may delimit an opening, which may also permit airflow between the cavity and the exterior of the second tubular element. In the case of the second end wall, the opening may be configured to so that air may flow from the exterior of the aerosol-generating article through the opening and into the cavity. The opening may therefore provide a conduit through which air can be drawn into the aerosol-generating article and through the aerosol-generating substrate.

The upstream element or second tubular element is preferably circumscribed by a wrapper. The wrapper circumscribing the upstream element or second tubular element is preferably a stiff plug wrap, for example, a plug wrap having a basis weight of at least about 80 grams per square metre (gsm), or at least about 100 gsm, or at least about 110 gsm. This provides structural rigidity to the upstream element.

As discussed above, the present disclosure also relates to an aerosol-generating system comprising an aerosol-generating device having a distal end and a mouth end. The aerosol-generating device comprises a body. The body of the aerosol-generating device defines a device cavity for removably receiving the aerosol-generating article at the mouth end of the device. The aerosol-generating device comprises a heating element or heater for heating the aerosol-generating substrate when the aerosol-generating article is received within the device cavity.

The device cavity may be referred to as the heating chamber of the aerosol-generating device. The device cavity may extend between a distal end and a mouth, or proximal, end. The distal end of the device cavity may be a closed end and the mouth, or proximal, end of the device cavity may be an open end. An aerosol-generating article may be inserted into the device cavity, or heating chamber, via the open end of the device cavity. The device cavity may be cylindrical in shape so as to conform to the same shape of an aerosol-generating article.

The expression "received within" may refer to the fact that a component or element is fully or partially received within another component or element. For example, the expression "aerosol-generating article is received within the device cavity" refers to the aerosol-generating article being fully or partially received within the device cavity of the aerosol-generating article. When the aerosol-generating article is received within the device cavity, the aerosol-generating article may abut the distal end of the device cavity. When the aerosol-generating article is received within the device cavity, the aerosol-generating article may be in substantial proximity to the distal end of the device cavity. The distal end of the device cavity may be defined by an end-wall.

The aerosol-generating device may comprise an elongate heater (or heating element) arranged for insertion into an aerosol-generating article when an aerosol-generating article is received within the device cavity. The elongate heater may be arranged with the device cavity. The elongate heater may extend into the device cavity. Alternative heating arrangements are discussed further below.

The heater may be any suitable type of heater.

Preferably, the heater may externally heat the aerosol-generating article when received within the aerosol-generating device. Such an external heater may circumscribe the aerosol-generating article when inserted in or received within the aerosol-generating device. In some embodiments, the heater is arranged to heat the outer surface of the aerosol-forming substrate. In some embodiments, the heater is arranged for insertion into an aerosol-forming substrate when the aerosol-forming substrate is received within the cavity. The heater may be positioned within the device cavity, or heating chamber.

The heater may comprise at least one heating element. The at least one heating element may be any suitable type of heating element. In some embodiments, the device comprises only one heating element. In some embodiments, the device comprises a plurality of heating elements. The heater may comprise at least one resistive heating element. Preferably, the heater comprises a plurality of resistive heating elements. Preferably, the resistive heating elements are electrically connected in a parallel arrangement. Advantageously, providing a plurality of resistive heating elements electrically connected in a parallel arrangement may facilitate the delivery of a desired electrical power to the heater while reducing or minimising the voltage required to provide the desired electrical power. Advantageously, reducing or minimising the voltage required to operate the heater may facilitate reducing or minimising the physical size of the power supply.

In some embodiments, the heater comprises an inductive heating arrangement. The inductive heating arrangement may comprise an inductor coil and a power supply configured to provide high frequency oscillating current to the inductor coil. As used herein, a high frequency oscillating current means an oscillating current having a frequency of between 500 KHz and 30 MHz. The heater may advantageously comprise a DC/AC inverter for converting a DC current supplied by a DC power supply to the alternating current. The inductor coil may be arranged to generate a high frequency oscillating electromagnetic field on receiving a high frequency oscillating current from the power supply. The inductor coil may be arranged to generate a high frequency oscillating electromagnetic field in the device cavity. In some embodiments, the inductor coil may substantially circumscribe the device cavity. The inductor coil may extend at least partially along the length of the device cavity.

The heater may comprise an inductive heating element. The inductive heating element may be a susceptor element. As used herein, the term 'susceptor element' refers to an element comprising a material that is capable of converting electromagnetic energy into heat. When a susceptor element is located in an alternating electromagnetic field, the susceptor is heated. Heating of the susceptor element may be the result of at least one of hysteresis losses and eddy currents induced in the susceptor, depending on the electrical and magnetic properties of the susceptor material.

A susceptor element may be arranged such that, when the aerosol-generating article is received in the cavity of the aerosol-generating device, the oscillating electromagnetic field generated by the inductor coil induces a current in the susceptor element, causing the susceptor element to heat up. In these embodiments, the aerosol-generating device is preferably capable of generating a fluctuating electromagnetic field having a magnetic field strength (H-field strength) of between 1 and 5 kilo amperes per metre (kA m), preferably between 2 and 3 kA/m, for example about 2.5 kA/m. The electrically-operated aerosol-generating device is preferably capable of generating a fluctuating electromagnetic field having a frequency of between 1 and 30 MHz, for example between 1 and 10 MHz, for example between 5 and 7 MHz.

In some embodiments, a susceptor element is located in the aerosol-generating article. In these embodiments, the susceptor element is preferably located in contact with the aerosol-forming substrate. The susceptor element may be located in the aerosol-forming substrate.

In some embodiments, a susceptor element is located in the aerosol-generating device. In these embodiments, the susceptor element may be located in the cavity. The aerosol-generating device may comprise only one susceptor element. The aerosol-generating device may comprise a plurality of susceptor elements.

In some embodiments, the susceptor element is arranged to heat the outer surface of the aerosol-forming substrate. In some embodiments, the susceptor element is arranged for insertion into an aerosol-forming substrate when the aerosol-forming substrate is received within the cavity.

The susceptor element may comprise any suitable material. The susceptor element may be formed from any material that can be inductively heated to a temperature sufficient to release volatile compounds from the aerosol-forming substrate. Suitable materials for the elongate susceptor element include graphite, molybdenum, silicon carbide, stainless steels, niobium, aluminium, nickel, nickel containing compounds, titanium, and composites of metallic materials. Some susceptor elements comprise a metal or carbon. Advantageously the susceptor element may comprise or consist of a ferromagnetic material, for example, ferritic iron, a ferromagnetic alloy, such as ferromagnetic steel or stainless steel, ferromagnetic particles, and ferrite. A suitable susceptor element may be, or comprise, aluminium. The susceptor element preferably comprises more than about 5 percent, preferably more than about 20 percent, more preferably more than about 50 percent or more than about 90 percent of ferromagnetic or paramagnetic materials. Some elongate susceptor elements may be heated to a temperature in excess of about 250 degrees Celsius.

The susceptor element may comprise a non-metallic core with a metal layer disposed on the non-metallic core. For example, the susceptor element may comprise metallic tracks formed on an outer surface of a ceramic core or substrate.

In some embodiments the aerosol-generating device may comprise at least one resistive heating element and at least one inductive heating element. In some embodiments the aerosol-generating device may comprise a combination of resistive heating elements and inductive heating elements.

During use, the heater may be controlled to operate within a defined operating temperature range, below a maximum operating temperature. An operating temperature range between about 150 degrees Celsius and about 250 degrees Celsius in the heating chamber (or device cavity) is preferable. The operating temperature range of the heater may be between about 150 degrees Celsius and about 250 degrees Celsius. The operating temperature range of the heater may be between about 180 degrees Celsius and about 200 degrees Celsius.

In embodiments where the aerosol-generating article comprises a ventilation zone at a location along the downstream section or the hollow tubular element, the ventilation zone may be arranged to be exposed when the aerosol-generating article is received within the device cavity.

The aerosol-generating device may comprise a power supply. The power supply may be a DC power supply. In some embodiments, the power supply is a battery.

The aerosol-generating article may have a length from about 35 millimetres to about 100 millimetres.

Preferably, an overall length of an aerosol-generating article in accordance with the invention is at least about 38 millimetres. More preferably, an overall length of an aerosol-generating article in accordance with the invention is at least about 40 millimetres. Even more preferably, an overall length of an aerosol-generating article in accordance with the invention is at least about 42 millimetres.

An overall length of an aerosol-generating article in accordance with the invention is preferably less than or equal to 70 millimetres. More preferably, an overall length of an aerosol-generating article in accordance with the invention is preferably less than or equal to 60 millimetres.

Even more preferably, an overall length of an aerosol-generating article in accordance with the invention is preferably less than or equal to 50 millimetres.

In some embodiments, an overall length of the aerosol-generating article is preferably from about 38 millimetres to about 70 millimetres, more preferably from about 40 millimetres to about 70 millimetres, even more preferably from about 42 millimetres to about 70 millimetres. In other embodiments, an overall length of the aerosol-generating article is preferably from about 38 millimetres to about 60 millimetres, more preferably from about 40 millimetres to about 60 millimetres, even more preferably from about 42 millimetres to about 60 millimetres. In further embodiments, an overall length of the aerosol-generating article is preferably from about 38 millimetres to about 50 millimetres, more preferably from about 40 millimetres to about 50 millimetres, even more preferably from about 42 millimetres to about 50 millimetres. In an exemplary embodiment, an overall length of the aerosol-generating article is about 45 millimetres.

The aerosol-generating article has an external diameter of at least 5 millimetres. Preferably, the aerosol-generating article has an external diameter of at least 6 millimetres. More preferably, the aerosol-generating article has an external diameter of at least 7 millimetres.

Preferably, the aerosol-generating article has an external diameter of less than or equal to about 12 millimetres. More preferably, the aerosol-generating article has an external diameter of less than or equal to about 10 millimetres. Even more preferably, the aerosol-generating article has an external diameter of less than or equal to about 8 millimetres.

In some embodiments, the aerosol-generating article has an external diameter from about 5 millimetres to about 12 millimetres, preferably from about 6 millimetres to about 12 millimetres, more preferably from about 7 millimetres to about 12 millimetres. In other embodiments, the aerosol-generating article has an external diameter from about 5 millimetres to about 10 millimetres, preferably from about 6 millimetres to about 10 millimetres, more preferably from about 7 millimetres to about 10 millimetres. In further embodiments, the aerosol-generating article has an external diameter from about 5 millimetres to about 8 millimetres, preferably from about 6 millimetres to about 8 millimetres, more preferably from about 7 millimetres to about 8 millimetres.

The aerosol-generating article may have a length of between 3.7 millimetres and 9 millimetres, or between 5.7 millimetres and 7.9 millimetres.

One or more of the components of the aerosol-generating article may be individually circumscribed by a wrapper. In preferred embodiments, all the components of the aerosol-generating article are individually circumscribed by their own wrapper. Preferably, at least one of the components of the aerosol-generating article is wrapped in a hydrophobic wrapper.

The term "hydrophobic" refers to a surface exhibiting water repelling properties. One useful way to determine this is to measure the water contact angle. The "water contact angle" is the angle, conventionally measured through the liquid, where a liquid/vapour interface meets a solid surface. It quantifies the wettability of a solid surface by a liquid via the Young equation. Hydrophobicity or water contact angle may be determined by utilizing TAPPI T558 test method and the result is presented as an interfacial contact angle and reported in "degrees" and can range from near zero to near 180 degrees.

In preferred embodiments, the hydrophobic wrapper is one including a paper layer having a water contact angle of about 30 degrees or greater, and preferably about 35 degrees or greater, or about 40 degrees or greater, or about 45 degrees or greater.

By way of example, the paper layer may comprise PVOH (polyvinyl alcohol) or silicon. The PVOH may be applied to the paper layer as a surface coating, or the paper layer may comprise a surface treatment comprising PVOH or silicon.

In a particularly preferred embodiment, an aerosol-generating article in accordance with the present invention comprises, in linear sequential arrangement, an aerosol-generating element comprising a rod comprising an aerosol-generating substrate and a hollow tubular element located immediately downstream of the aerosol-generating element.

In more detail, the hollow tubular element may abut the aerosol-generating element.

The aerosol-generating article has a substantially cylindrical shape and an outer diameter of about 7.3 millimetres.

The hollow tubular element is in the form of a hollow cellulose acetate tube and has an internal diameter of about 7.1 millimetres. Thus, a thickness of a peripheral wall of the hollow tubular element is about 0.1 millimetres. A ventilation zone is provided at a location along the hollow tubular element.

The aerosol-generating element is in the form of a rod of aerosol-generating substrate circumscribed by a paper wrapper, and comprises at least one of the types of aerosol-generating substrate described above, such as plant cut filler, and particularly tobacco cut filler, homogenised tobacco, a gel formulation or a homogenised plant material comprising particles of a plant other than tobacco.

An outer tipping wrapper circumscribes the hollow tubular element and a portion of the aerosol-generating element, such that the hollow tubular element is attached to the aerosol-generating element.

The rod of aerosol-generating substrate has a length of about 12 millimetres, the hollow tubular element has a length of about 33 millimetres or about 29 millimetres. Thus, an overall length of the aerosol-generating article is about 45 millimetres or about 41 millimetres.

In another preferred embodiment, an aerosol-generating article in accordance with the present invention comprises, in linear sequential arrangement, an upstream element, an aerosol-generating element located immediately downstream of the upstream element, the aerosol-generating element comprising a rod comprising an aerosol-generating substrate, and a hollow tubular element located immediately downstream of the aerosol-generating element.

In more detail, the rod of aerosol-generating substrate may abut the upstream element. Further, the hollow tubular element may abut the aerosol-generating element.

The aerosol-generating article has a substantially cylindrical shape and an outer diameter of about 7.3 millimetres.

The hollow tubular element is in the form of a hollow cellulose acetate tube and has an internal diameter of about 7.1 millimetres. Thus, a thickness of a peripheral wall of the hollow tubular element is about 0.1 millimetres. A ventilation zone is provided at a location along the hollow tubular element.

The aerosol-generating element is in the form of a rod of aerosol-generating substrate circumscribed by a paper wrapper, and comprises at least one of the types of aerosol-generating substrate described above, such as plant cut filler, and particularly tobacco cut filler, homogenised tobacco, a gel formulation or a homogenised plant material comprising particles of a plant other than tobacco.

An outer tipping wrapper circumscribes the hollow tubular element and a portion of the aerosol-generating element, such that the hollow tubular element is attached to the aerosol-generating element.

The upstream element has a length of 5 millimetres, the rod of aerosol-generating substrate has a length of about 12 millimetres, the hollow tubular element has a length of about 28 millimetres. Thus, an overall length of the aerosol-generating article is about 45 millimetres.

The invention is defined in the claims. However, below there is provided a non-exhaustive list of non-limiting examples. Any one or more of the features of these examples may be combined with any one or more features of another example, embodiment, or aspect described herein.

Example 1

An aerosol-generating article, the aerosol-generating article comprising: an aerosol-generating substrate; a downstream section extending from a downstream end of the aerosol-generating substrate to a downstream end of the aerosol-generating article; and an upstream section extending from an upstream end of the aerosol-generating substrate to an upstream end of the aerosol-generating article, wherein the ratio of the resistance to draw of the upstream section to the resistance to draw of the downstream section is more than 1.

Example 2

An aerosol-generating article according to Example 1, wherein the resistance to draw of the downstream section is less than 150 mm $H_2O$.

Example 3

An aerosol-generating article according to Example 1 or Example 2, wherein the resistance to draw of the upstream section is at least 5 mm $H_2O$.

Example 4

An aerosol-generating article according to any preceding Example, wherein the resistance to draw of the upstream section is between 5 mm $H_2O$ and 80 mm $H_2O$.

Example 5

An aerosol-generating article according to any preceding Example, wherein the upstream section comprises a plug comprising cellulose acetate.

Example 6

An aerosol-generating article according to Example 5, wherein the plug comprising cellulose acetate abuts the upstream end of the aerosol-generating substrate.

Example 7

An aerosol-generating article according to any preceding Example, wherein the upstream section has a length of between 1 millimetre and 15 millimetres.

Example 8

An aerosol-generating article according to any preceding Example, wherein the total resistance to draw of the aerosol-generating article is between 1 mm $H_2O$ and 25 mm $H_2O$.

Example 9

An aerosol-generating article according to any preceding Example, wherein the downstream section comprises an unobstructed airflow pathway from the downstream end of the aerosol-generating substrate to the downstream end of the downstream section.

Example 10

An aerosol-generating article according to Example 9, wherein the unobstructed airflow pathway from the downstream end of the aerosol-generating substrate to the downstream end of the downstream section has a minimum diameter of 3 millimetres.

Example 11

An aerosol-generating article according to any preceding Example, wherein the downstream section comprises a hollow tubular element.

Example 12

An aerosol-generating article according to any preceding Example, wherein the downstream section has a length of at least 15 millimetres.

Example 13

An aerosol-generating article according to any preceding Example, wherein the downstream section comprises a first ventilation zone for providing ventilation into the downstream section.

Example 14

An aerosol-generating article according to Example 13, wherein the first ventilation zone comprises a first line of perforation holes circumscribing the downstream section.

Example 15

An aerosol-generating system comprising, an aerosol-generating device comprising a heater, and an aerosol-generating article according to any preceding Example.

In the following, the invention will be further described with reference to the drawings of the accompanying Figures, wherein.

Figure 1:
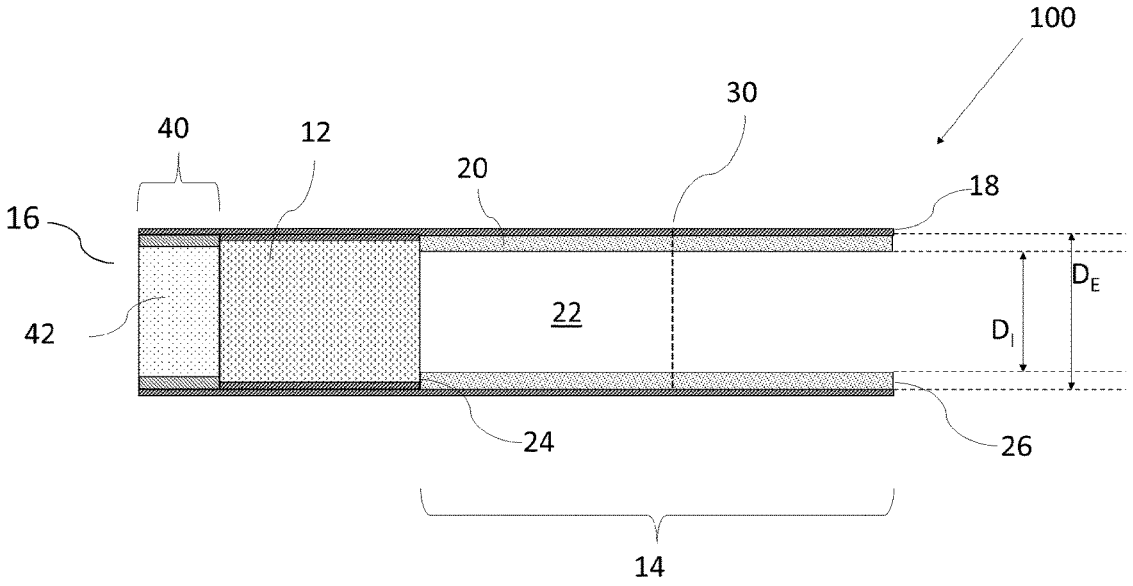
FIG. 1 shows a schematic side sectional view of an aerosol-generating article in accordance with an embodiment of the invention.

The aerosol-generating article 100 shown in FIG. 1 comprises a rod of aerosol-generating substrate 12 and a downstream section 14 at a location downstream of the rod 12 of aerosol-generating substrate.

The aerosol-generating article 100 further comprises an upstream section at a location upstream of the aerosol-generating element.

The aerosol-generating article 100 comprises an upstream section comprising only one upstream element 40 at a location upstream of the aerosol-generating substrate 12. As such, the aerosol-generating article 100 extends from a distal end 16 substantially coinciding with an upstream end of the upstream element 40 to a mouth end or downstream end 18 substantially coinciding with a downstream end of the downstream section 14.

The upstream section 40 comprises an upstream element 42 located immediately upstream of the rod 12 of aerosol-generating substrate, the upstream element 42 being in longitudinal alignment with the rod 12. In the embodiment of FIG. 1, the downstream end of the upstream element 42 abuts the upstream end of the rod 12 of aerosol-generating substrate. The upstream element 42 is provided in the form of a cylindrical plug of cellulose acetate circumscribed by a stiff wrapper. The upstream element 42 has a length of about 5 millimetres. The RTD of the upstream element 42 is about 30 millimetres $H_2O$.

The aerosol-generating article 100 has an overall length of about 45 millimetres.

The aerosol-generating substrate 12 comprises tobacco cut filler impregnated with about 12 percent by weight of an aerosol former, such as glycerin. The tobacco cut filler comprises 90 percent by weight of tobacco leaf lamina. The cut width of the tobacco cut filler is about 0.7 millimetres. The rod of aerosol-generating substrate 12 comprises about 130 milligrams of tobacco cut filler.

The downstream section 14 comprises a hollow tubular element 20 located immediately downstream of the aerosol-generating substrate 12, the hollow tubular element 20 being in longitudinal alignment with the aerosol-generating substrate 12. In the embodiment of FIG. 1, the upstream end of the hollow tubular element 20 abuts the downstream end of the rod 12 of aerosol-generating substrate.

The hollow tubular element 20 defines a hollow section of the aerosol-generating article 100. The hollow tubular element does not substantially contribute to the overall RTD of the aerosol-generating article. In more detail, an RTD of the downstream section is about 0 mm $H_2O$.

The hollow tubular element 20 is provided in the form of a hollow cylindrical tube made of cellulose acetate or of stiff paper, such as paper having a grammage of at least about 90 g/sqm. The hollow tubular element 20 defines an internal cavity 22 that extends all the way from an upstream end 24 of the hollow tubular element to a downstream end 26 of the hollow tubular element 20. The internal cavity 22 is substantially empty, and so substantially unrestricted airflow is enabled along the internal cavity 22. The hollow tubular element 20 does not substantially contribute to the overall RTD of the aerosol-generating article 100.

The hollow tubular element 20 has a length of about 33 millimetres, an external diameter ($D_E$) of about 7.3 millimetres, and an internal diameter ($D_I$) of about 7.1 millimetres. Thus, a thickness of a peripheral wall of the hollow tubular element 20 is about 0.1 millimetres.

The aerosol-generating article 100 comprises a ventilation zone 30 provided at a location along the hollow tubular element 20. In more detail, the ventilation zone 30 is provided at about 18 millimetres from the downstream end 26 of the hollow tubular element 20. As such, in the embodiment of FIG. 1 the ventilation zone 30 is effectively provided at 18 millimetres from the mouth end 18 of the aerosol-generating article 100. A ventilation level of the aerosol-generating article 100 is about 40 percent.

In the embodiment of FIG. 1, the aerosol-generating article does not comprise any additional component downstream of the hollow tubular element 20.

Figure 2:
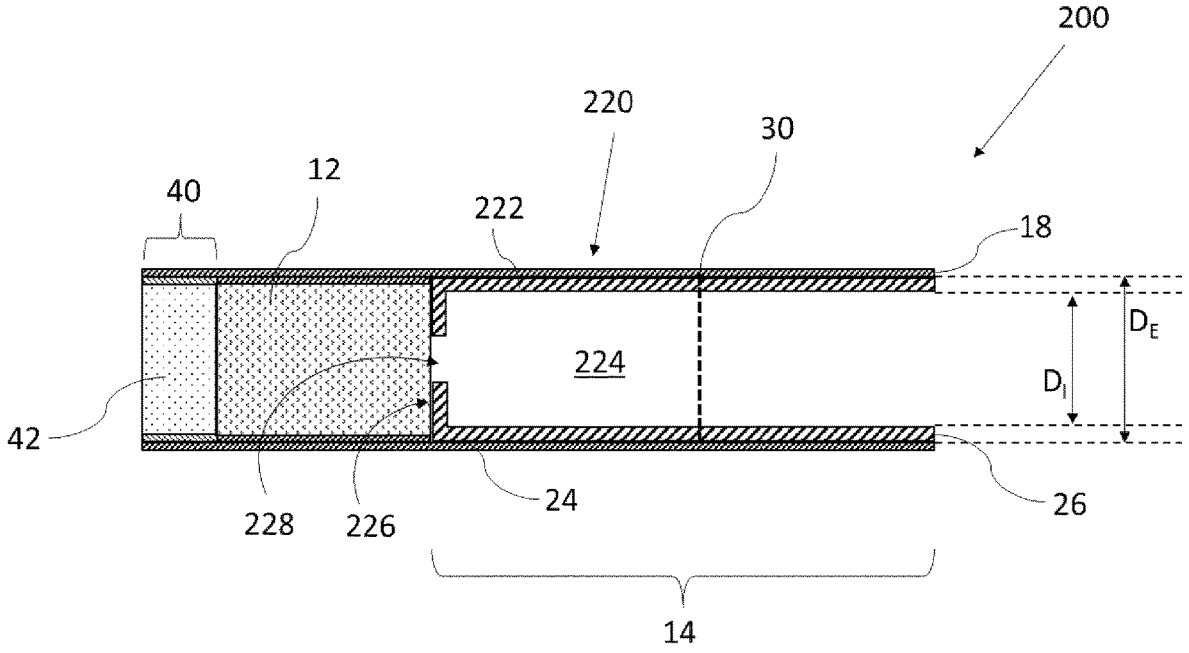
FIG. 2 shows a schematic side sectional view of a variant of the aerosol-generating article of FIG. 1.

FIG. 2 shows an aerosol-generating article 200 which is a variant of the aerosol-generating article 10 described above. The aerosol-generating article 200 is generally the same as the aerosol-generating article 10 of the embodiment of FIG. 1, with the exception that the aerosol-generating article 200 of the variant of the first embodiment does not comprise a cylindrical hollow tubular element 20 as described above. Instead, the aerosol-generating article 200 of the variant of the first embodiment comprises a modified tubular element 220 located immediately downstream of the aerosol-generating element 12.

The modified tubular element 220 comprises a tubular body 222 defining a cavity 224 extending from a first end of the tubular body 222 to a second end of the tubular body 222. The modified tubular element 220 also comprises a folded end portion forming a first end wall 226 at the first end of the tubular body 222. The first end wall 226 delimits an opening 228, which permits airflow between the cavity 224 and the exterior of the modified tubular element 220. In particular, the embodiment of FIG. 3 is configured so that aerosol may flow from the aerosol-generating element 12 through the opening 228 into the cavity 224.

Much like the cavity 22 of the first embodiment shown in FIG. 1, the cavity 224 of the tubular body 222 is substantially empty, and so substantially unrestricted airflow is enabled along the cavity 222. Consequently, the RTD of the modified tubular element 220 can be localised at a specific longitudinal position of the modified tubular element 220—namely, at the first end wall 226—and can be controlled through the chosen configuration of the first end wall 226 and its corresponding opening 228. In the embodiment of FIG. 3, the RTD of the modified tubular element 220 (which is essentially the RTD of the first end wall 226) is about millimetres $H_2O$.

In the embodiment of FIG. 2, the modified tubular element 220 has a length of about 33 millimetres, an external diameter ($D_E$) of about 7.3 millimetres, and an internal diameter ($D_{FTS}$) of about 7.1 millimetres. Thus, a thickness of a peripheral wall of the tubular body 222 is about 0.1 millimetres.

Figure 3:
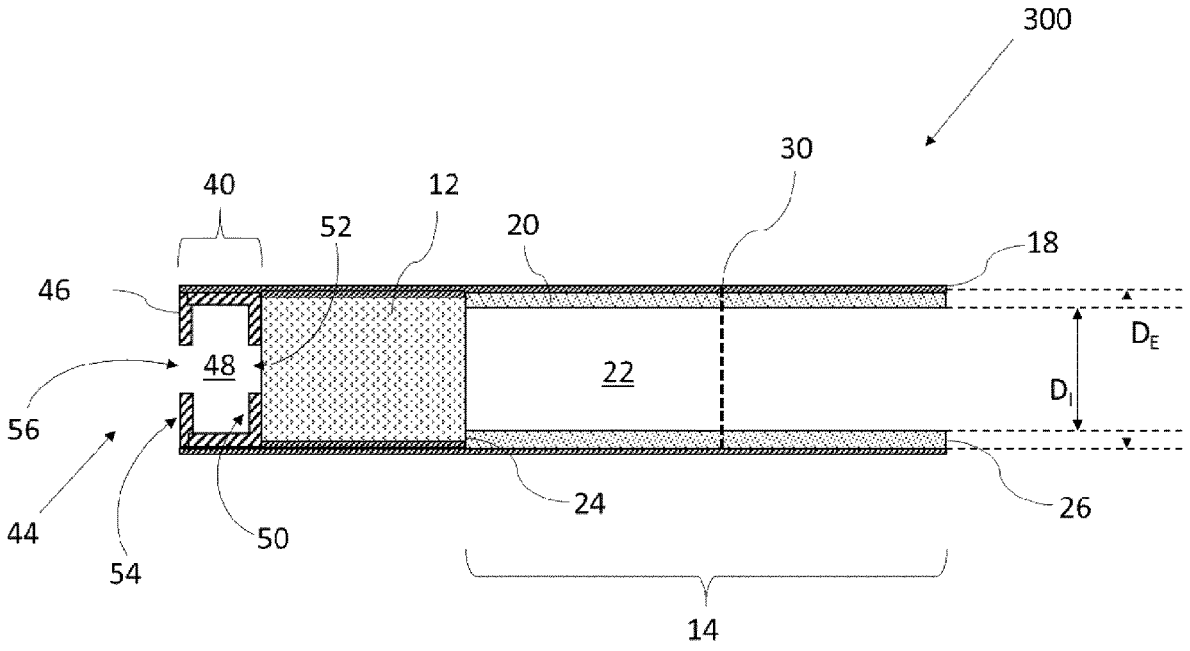
FIG. 3 shows a schematic side sectional view of a variant of the aerosol-generating article of FIG. 1.

FIG. 3 shows an aerosol-generating article 300 which is a variant of the aerosol-generating article 10 described above. The aerosol-generating article 300 is generally the same as the aerosol-generating article 100 of the embodiment of FIG. 1, with the exception that the aerosol-generating article 300 of the variant of the second embodiment does not comprise an upstream element 42 provided in the form of a cylindrical plug of cellulose acetate circumscribed by a stiff wrapper. Instead, the aerosol-generating article 300 comprises a second tubular element 44 located immediately upstream of the aerosol-generating element 12. Consequently, the hollow tubular element 20 located immediately downstream of the aerosol-generating element 12 can be referred to as a first tubular element 20.

The second tubular element 44 comprises a tubular body 46 defining a cavity 48 extending from a first end of the tubular body 46 to a second end of the tubular body 46. The second tubular element 44 also comprises a folded end portion forming a first end wall 50 at the first end of the tubular body 46. The first end wall 50 delimits an opening 52, which permits airflow between the cavity 48 and the exterior of the second tubular element 44. In particular, the embodiment of FIG. 3 is configured so that air may flow from the cavity 48 through the opening 52 and into the aerosol-generating element 12.

Further, the second tubular element 44 comprises a second end wall 54 at the second end of its tubular body 46. This second end wall 54 is formed by folding an end portion of the second tubular element 44 at the second end of the tubular body 46. The second end wall 54 delimits an opening 56, which also permits airflow between the cavity 48 and the exterior of the second tubular element 44. In the case of the second end wall 54, the opening 56 is configured to so that air may flow from the exterior of the aerosol-generating article 300 through the opening 56 and into the cavity 48. The opening 56 therefore provides a conduit through which air can be drawn into the aerosol-generating article 300 and through the aerosol-generating element 12.

In the variant of FIG. 3, a downstream end of the second tubular element 44 abuts the upstream end of the rod 12 of aerosol-generating substrate. The second tubular element 44 has a length of about 5 millimetres. The RTD of the second tubular element 44 is about 5 millimetres $H_2O$.

The invention claimed is:

1. An aerosol-generating article, comprising:

an aerosol-generating substrate;

a downstream section extending from a downstream end of the aerosol-generating substrate to a downstream end of the aerosol-generating article; and an upstream section extending from an upstream end of the aerosol-generating substrate to an upstream end of the aerosol-generating article, wherein a ratio of a resistance-to-draw of the upstream section to a resistance-to-draw of the downstream section is more than 1, and wherein the resistance-to-draw of the upstream section is no more than 150 mm $H_2O$.

2. The aerosol-generating article according to claim 1, wherein the resistance-to-draw of the downstream section is less than 150 mm $H_2O$.

3. The aerosol-generating article according to claim 1, wherein the resistance-to-draw of the upstream section is at least 5 mm $H_2O$.

4. The aerosol-generating article according to claim 1, wherein the resistance-to-draw of the upstream section is between 5 mm $H_2O$ and 80 mm $H_2O$.

5. The aerosol-generating article according to claim 1, wherein the upstream section comprises a plug comprising cellulose acetate.

6. The aerosol-generating article according to claim 5, wherein the plug comprising cellulose acetate abuts the upstream end of the aerosol-generating substrate.

7. The aerosol-generating article according to claim 1, wherein the upstream section has a length of between 1 millimetre and 15 millimetres.

8. The aerosol-generating article according to claim 1, wherein a total resistance-to-draw of the aerosol-generating article is between 1 mm $H_2O$ and 25 mm $H_2O$.

9. The aerosol-generating article according to claim 1, wherein the downstream section comprises an unobstructed airflow pathway from the downstream end of the aerosol-generating substrate to the downstream end of the downstream section.

10. The aerosol-generating article according to claim 9, wherein the unobstructed airflow pathway from the downstream end of the aerosol-generating substrate to the downstream end of the downstream section has a minimum diameter of 3 millimetres.

11. The aerosol-generating article according to claim 1, wherein the downstream section comprises a hollow tubular element.

12. The aerosol-generating article according to claim 1, wherein the downstream section has a length of at least 15 millimetres.

13. The aerosol-generating article according to claim 1, wherein the downstream section comprises a first ventilation zone configured to provide ventilation into the downstream section.

14. The aerosol-generating article according to claim 13, wherein the first ventilation zone comprises a first line of perforation holes circumscribing the downstream section.

15. An aerosol-generating system, comprising, an aerosol-generating device comprising a heater; and an aerosol-generating article according to claim 1.

16. An aerosol-generating article, comprising:

an aerosol-generating substrate;

a downstream section extending from a downstream end of the aerosol-generating substrate to a downstream end of the aerosol-generating article; and an upstream section extending from an upstream end of the aerosol-generating substrate to an upstream end of the aerosol-generating article, wherein the upstream section comprises a plug made of a filter material, wherein the plug made of a filter material abuts the upstream end of the aerosol-generating substrate, wherein a ratio of a resistance-to-draw of the upstream section to a resistance-to-draw of the downstream section is more than 1, and wherein the resistance-to-draw of the upstream section is no more than 150 mm $H_2O$.

17. An aerosol-generating article, comprising:

an aerosol-generating substrate;

a downstream section extending from a downstream end of the aerosol-generating substrate to a downstream end of the aerosol-generating article; and an upstream section extending from an upstream end of the aerosol-generating substrate to an upstream end of the aerosol-generating article, wherein the upstream section comprises a plug comprising cellulose acetate, wherein the plug comprising cellulose acetate abuts the upstream end of the aerosol-generating substrate, wherein a ratio of a resistance-to-draw of the upstream section to a resistance-to-draw of the downstream section is more than 1, and wherein the resistance-to-draw of the upstream section is no more than 150 mm $H_2O$.

* * * * *